US008662630B2

(12) United States Patent
Kakigahara

(10) Patent No.: US 8,662,630 B2
(45) Date of Patent: Mar. 4, 2014

(54) RECORDING APPARATUS

(75) Inventor: Yutaka Kakigahara, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 320 days.

(21) Appl. No.: 13/284,424

(22) Filed: Oct. 28, 2011

(65) Prior Publication Data

US 2012/0105523 A1 May 3, 2012

(30) Foreign Application Priority Data

Oct. 29, 2010 (JP) ..... 2010-244450

(51) Int. Cl.
*B41J 2/165* (2006.01)

(52) U.S. Cl.
USPC ..... 347/29; 347/23

(58) Field of Classification Search
CPC . B41J 2/16505; B41J 2/16508; B41J 2/16511
USPC ..... 347/19, 29
See application file for complete search history.

(56) References Cited

U.S. PATENT DOCUMENTS 7,370,935 B2 * 5/2008 Usuda ..... 347/23
2007/0206047 A1 9/2007 Matsuda

FOREIGN PATENT DOCUMENTS

JP H09-085959 A 3/1997
JP H09-109403 A 4/1997
JP H10-202922 A 8/1998
JP 2001-113683 A 4/2001
JP 2002-059559 A 2/2002
JP 2002-210938 A 7/2002

OTHER PUBLICATIONS

European Patent Office, extended European Search Report for European Patent Application No. 11187033.3 (counterpart to above-captioned patent application), dated Jan. 18, 2012.

* cited by examiner

*Primary Examiner* — Julian Huffman
(74) *Attorney, Agent, or Firm* — Baker Botts L.L.P.

(57) ABSTRACT

A recording apparatus including: a liquid ejection head which has an ejection surface; a conveying mechanism having a support surface, and configured to convey a recording medium; a first capping mechanism having an annular-shaped lip member disposed to surround the ejection surface of the liquid ejection head, and configured to execute a first capping that causes the ejection surface to be covered with the support surface and the lip member; a second capping mechanism having a movable member which is positionable in an opposed position and a retracted position, and configured to execute a second capping that causes the ejection surface to be covered with at least the one movable member that is positioned in the opposed position; and a controller configured to control the first capping mechanism and the second capping mechanism, and to execute a selected one of the first capping and the second capping.

19 Claims, 8 Drawing Sheets

RECORDING APPARATUS

CROSS REFERENCE TO RELATED APPLICATION

This application claims priority from Japanese Patent Application No. 2010.244450 filed on Oct. 29, 2010, the disclosures of which are herein incorporated by reference in their entirety.

BACKGROUND OF THE INVENTION

Field of the Invention

The present invention relates to a recording apparatus configured to eject liquid onto a recording medium.

There is known an inkjet recording apparatus (hereinafter referred to as "inkjet recording apparatus A") including a recording head and a cap member which is disposed around the recording head and which is to be brought into contact with a support surface (constituted by a surface of an endless belt) whereby an ejection surface of the recording head is covered or capped.

There is also known an inkjet recording apparatus (hereinafter referred to as "inkjet recording apparatus B") including a recording head and a cap which is to be moved to a space defined between an ejection surface of the recording head and a support surface (constituted by a surface of an endless belt) that are movable toward and away from each other. The cap, which has been moved to the space, is then brought into contact with the ejection surface whereby the ejection surface of the recording head is covered or capped.

SUMMARY OF THE INVENTION

The above-described inkjet recording apparatus A includes the cap member that cooperates with the support surface to cap the ejection surface. Meanwhile, the above-described inkjet recording apparatus B includes the cap that caps the ejection surface without cooperation with the support surface. The recording apparatus A does not include the cap that is included in the recording apparatus B, while the recording apparatus B does not include the cap member that is included in the recording apparatus A. That is, in either of the apparatuses A, B, as means for capping the ejection surface, there is no alternative means that is to be selected in place of the cap or the cap member.

According to aspect described therein, a recording apparatus includes: (a) at least one liquid ejection head each of which has an ejection surface defining ejection openings, and each of which is configured to eject liquid through the ejection openings; (b) a conveying mechanism having a support surface, and configured to convey a recording medium, such that the recording medium supported on the support surface passes a position that is opposed to the ejection surface; (c) a first capping mechanism including at least one annular-shaped lip member each of which is disposed around a corresponding one of the at least one liquid ejection head so as to surround the ejection surface of the corresponding one of the at least one liquid ejection head, the first capping mechanism being configured to execute a first capping that causes the ejection surface of each of the at least one liquid ejection head to be covered with the support surface and a corresponding one of the at least one annular-shaped lip member, by bringing a lower end of the corresponding one of the at least one annular-shaped lip member into contact with the support surface; (d) a second capping mechanism including at least one movable member each of which is positionable in an opposed position and a retracted position, such that each of the at least one movable member is opposed to the ejection surface of a corresponding one of the at least one liquid ejection head while being positioned in the opposed position, and such that each of the at least one movable member is not opposed to the ejection surface of a corresponding one of the at least one liquid ejection head while being positioned in the retracted position, the second capping mechanism being configured to execute a second capping that causes the ejection surface of each of the at least one liquid ejection head to be covered with at least a corresponding one of the at least one movable member, by positioning the corresponding one of the at least one movable member in the opposed position; and (e) a controller configured to control the first capping mechanism and the second capping mechanism, and to execute a selected one of the first capping and the second capping.

VARIOUS MODES OF THE INVENTION

The above-described object may be achieved by a recording apparatus constructed according to any one of the following modes of the present invention, each of which is numbered like the appended claims and depends from the other mode or modes, where appropriate, to indicate and clarify possible combinations of elements or technical features. It is to be understood that the present invention is not limited to the technical features or any combinations thereof which will be described for illustrative purpose only. It is to be further understood that a plurality of elements or features included in any one of the following modes of the invention are not necessarily provided all together, and that the invention may be embodied without some of the elements or features described with respect to the same mode.

(1) A recording apparatus includes:

at least one liquid ejection head each of which has an ejection surface defining ejection openings, and each of which is configured to eject liquid through the ejection openings;

a conveying mechanism having a support surface, and configured to convey a recording medium, such that the recording medium supported on the support surface passes a position that is opposed to the ejection surface;

a first capping mechanism including at least one annular-shaped lip member each of which is disposed around a corresponding one of the at least one liquid ejection head so as to surround the ejection surface of the corresponding one of the at least one liquid ejection head, the first capping mechanism being configured to execute a first capping that causes the ejection surface of each of the at least one liquid ejection head to be covered with the support surface and a corresponding one of the at least one annular-shaped lip member, by bringing a lower end of the corresponding one of the at least one annular-shaped lip member into contact with the support surface;

a second capping mechanism including at least one movable member each of which is positionable in an opposed position and a retracted position, such that each of the at least one movable member is opposed to the ejection surface of a corresponding one of the at least one liquid ejection head while being positioned in the opposed position, and such that each of the at least one movable member is not opposed to the ejection surface of a corresponding one of the at least one liquid ejection head while being positioned in the retracted position, the second capping mechanism being configured to execute a second capping that causes the ejection surface of each of the at least one liquid ejection head to be covered with at least a corresponding one of the at least one movable member, by positioning the corresponding one of the at least one movable member in the opposed position; and a controller configured to control the first capping mechanism and the second capping mechanism, and to execute a selected one of the first capping and the second capping.

In the recording apparatus according to this mode (1), either one of the first and second cappings as a suitably selected capping can be executed.

(2) The recording apparatus according to mode (1), further comprising a movement mechanism configured to move the at least one liquid ejection head and/or the conveying mechanism, for enabling each of the at least one liquid ejection head and the conveying mechanism to cooperate to establish a recordable state and a distant state, such that the recordable state is established, when an image is to be recorded onto the recording medium that is conveyed by the conveying mechanism, by causing the each of the at least one liquid ejection head to eject the liquid toward the recording medium, and such that the each of the at least one liquid ejection head and the support surface are distant from each other by a larger distance when the distant state is being established than when the recordable state is being established, wherein the controller is configured, when the first capping is to be executed, to control the movement mechanism such that the recordable state is established by cooperation of the each of the at least one liquid ejection head and the conveying mechanism, and wherein the controller is configured, when the second capping is to be executed to control the movement mechanism such that the distant state is established by cooperation of the each of the at least one liquid ejection head and the conveying mechanism.

In the recording apparatus according to this mode (2), it is possible to execute one of the cappings which is selected suitably depending on an operating status (e.g., a condition of ejection of liquid from the liquid ejection head, a mode selected by a user of the apparatus). Therefore, the controller can be considered to execute one of the first and second cappings which is selected suitably depending on the operating status.

(3) The recording apparatus according to mode (1) or (2), wherein the ejection surface of each of the at least one liquid ejection head cooperates with the support surface and the corresponding one of the at least one annular-shaped lip member to define an enclosed space upon execution of the first capping, wherein the ejection surface of each of the at least one liquid ejection head cooperates with at least the corresponding one of the at least one movable member to define an enclosed space upon execution of the second capping, and wherein a degree of tightness of the enclosed space defined upon execution of the second capping is higher than a degree of tightness of the enclosed space defined upon execution of the first capping.

It is preferable that the degree of tightness of the enclosed space defined upon execution of the second capping is higher than the degree of tightness of the enclosed space defined upon execution of the first capping, because the first capping, which is executed by using the support surface, exhibits a lower performance for preserving the liquid in the vicinity of the ejection openings, than the second capping.

Further, it is preferable that the controller includes a judging portion configured to judge whether there is a possibility that at least a predetermined length of time will elapse without any ejection of the liquid from the at least one liquid ejection head toward the recording medium, and that the second capping is executed when it is judged by the judging portion that no ejection of the liquid from the at least one liquid ejection head toward the recording medium will be carried out for at least the predetermined length of time. According to this preferable arrangement, even when the predetermined length of time has elapsed without any ejection of the liquid from the at least one liquid ejection head toward the recording medium, it is possible to restrain the liquid staying in the vicinity of the ejection openings, from being dried.

(4) The recording apparatus according to any one of modes (1)-(3), further includes:

at least one liquid reservoir each of which is configured to supply the liquid to a corresponding one of the at least one liquid ejection head; and at least one liquid detector each of which is configured to detect that an amount of the liquid reserved in a corresponding one of the at least one liquid reservoir is not larger than a predetermined amount, wherein the controller is configured, when each of the at least one liquid detector detects that the amount of the liquid reserved in a corresponding one of the at least one liquid reservoir is not larger than the predetermined amount, to execute the second capping.

In the recording apparatus according to this mode (4), it is possible to restrain drying of the liquid staying in the vicinity of the ejection openings, until the liquid reservoir is filled with the liquid or is replaced by another liquid reservoir.

(5) The recording apparatus according to any one of modes (1)-(4), further includes:

a recording-medium storage configured to store therein the recording medium; and a recording-medium detector configured to detect whether the recording medium is present or absent in the recording-medium storage, wherein the controller is configured to execute the second capping, when the recording medium detector detects that the recording medium is absent in the recording-medium storage.

In the recording apparatus according to this mode (5), it is possible to restrain drying of the liquid staying in the vicinity of the ejection openings, until the recording medium is stored in the recording-medium storage.

(6) The recording apparatus according to any one of modes (1)-(5), further includes:

a recording-medium storage which is configured to store therein the recording medium, and which is removably attached to a main body of the recording apparatus; and a storage disposition detector configured to detect whether the recording-medium storage is disposed in a supplying position that enables the recording medium to be supplied from the recording-medium storage to the conveying mechanism, wherein the controller is configured to execute the second capping, when the storage disposition detector detects that the recording-medium storage is not disposed in the supplying position.

In the recording apparatus according to this mode (6), it is possible to restrain drying of the liquid staying in the vicinity of the ejection openings, until the recording-medium storage is disposed in the supplying position.

(7) The recording apparatus according to any one of modes (1)-(6), further comprising a conveyance-error detector configured to detect an error in conveyance of the recording medium by the conveying mechanism, wherein the controller is configured to execute the second capping, when the conveyance-error detector detects the error in the conveyance of the recording medium.

In the recording apparatus according to this mode (7), it is possible to restrain drying of the liquid staying in the vicinity of the ejection openings, until the error or failure of the recording medium conveying is resolved.

(8) The recording apparatus according to any one of modes (1)-(7), wherein the controller includes a power-saving-state placing portion configured to place the recording apparatus into a power-saving state in which an amount of electric current supplied to the recording apparatus is smaller than in a state in which the image is recorded on the recording medium, and wherein the controller is configured to execute the second capping, when the recording apparatus is placed in the power-saving state by the power-saving-state placing portion.

In the recording apparatus according to this made (8), it is possible to restrain drying of the liquid staying in the vicinity of the ejection openings, when a power supply of the apparatus is being placed in OFF state with a power button having been pressed by the user, or when the power supply of the apparatus is being placed in OFF state during a maintenance operation, namely, when consumption of the electric power is restrained in the apparatus.

(9) The recording apparatus according to any one of modes (1)-(8), wherein the controller further includes an ejection-mode establishing portion configured to establish selectively a first ejection mode and a second ejection mode, such that the liquid is ejected through the ejection openings for maintenance of the ejection openings when either one of the first and second ejection modes is being established, and such that an amount of the liquid ejected through the ejection openings is smaller when the second ejection mode is being established, than when the first ejection mode is being established, and wherein the controller is configured to execute the first capping when the first ejection mode is being established, and to execute the second capping when the second ejection mode is being established.

Since the first capping is executed by using the support surface, there is a case where the first capping exhibits a lower performance for preserving the liquid in the vicinity of the ejection openings, than the second capping. In the recording apparatus according to this mode (9), even when the second ejection mode, which consumes less amount of the liquid for the maintenance operation, is established by the user, the second capping is executed thereby making it possible to effectively restrain drying of the liquid staying in the vicinity of the ejection openings.

(10) The recording apparatus according to mode (9), wherein the controller includes a preliminary-ejection controlling portion configured to control the at least one liquid ejection head such that the liquid is preliminarily ejected through the ejection openings, and wherein the preliminary-ejection controlling portion is configured to cause the liquid to be preliminarily ejected through the ejection openings by an amount smaller when the second ejection mode is being established, than when the first ejection mode is being established.

In the recording apparatus according to this mode (10), the ejection openings can be restored effectively, by causing the liquid to be preliminarily ejected through the ejection openings by an amount that is dependent on the established ejection mode.

(11) The recording apparatus according to mode (9) or (10), wherein the controller includes a purge executing portion configured to cause the liquid to be forcedly ejected from the at least one liquid ejection head, and wherein the purge executing portion is configured to cause the liquid to be forcedly ejected through the ejection openings by an amount smaller when the second ejection mode is being established, than when the first ejection mode is being established.

In the recording apparatus according to this mode (11), the ejection openings can be restored effectively, by causing the liquid to be forcedly discharged or ejected through the ejection openings by an amount that is dependent on the established ejection mode.

(12) The recording apparatus according to any one of modes (1)-(11), wherein the controller further includes a recording-mode establishing portion configured to establish selectively a first recording mode and a second recording mode, such that the liquid is ejected toward the recording medium in response to reception of a recording data by the controller when either of the first and second recording modes is being established, and such that a length of time from the reception of the recording data to ejection of the liquid is shorter when the second recording mode is being established, than when the first ejection mode is being established, and wherein the controller is configured to execute the second capping when the first recording mode is being established, and to execute the first capping when the second recording mode is being established.

Since the first capping is executed by using the support surface, there is a case where the first capping exhibits a lower performance for preserving the liquid in the vicinity of the ejection openings, than the second capping. Further, since the movement mechanism and the second capping mechanism require to be controlled for executing the second capping, there is a case where the length of time from release of the second capping to establishment of the liquid ejectable state is larger than a length of time from release of the first capping to establishment of the liquid ejectable state. In the recording apparatus according to this mode (12), it is possible to execute one of the first and second cappings which is selected suitably depending on the established recording mode. When the first recording mode is established, it is possible to obtain a high performance for preserving the liquid in the vicinity of the ejection openings, since the second capping is executed during the first recording mode. When the second recording mode is established, it is possible to reduce the length of time from reception of print data to ejection of the liquid toward the recording medium, since the first capping is executed during the second recording mode.

(13) The recording apparatus according to any one of modes (1)-(12), wherein the controller is configured to execute the first capping, when ejection of the liquid required for an image recording operation performed onto the recording medium is completed, and wherein the controller is configured to release the first capping and to execute the second capping, when a predetermined length of time has passed from completion of the ejection of the liquid, without a next image recording operation being performed.

In the recording apparatus according to this mode (13), when a next image recording operation is carried out within the predetermined length of time after the completion of ejection of the liquid for the previous image recording operation, the first capping is executed so that it is possible to reduce a length of time required for starting the next recording operation. When the next image recording operation is not performed even after the predetermined length of time has passed, the second capping is executed so that it is possible to effectively restrain drying of the liquid staying in the vicinity of the ejection openings.

The controller may further include: a time measuring portion configured to measure a length of time; a storage portion configured to store, based on the length of time measured by the time measuring portion, points of times at which a recording command is received by the controller; and a counting portion configured to count a number of times the recording command has been received by the controller in each of a plurality of divided periods. Further, it is preferable that the controller is configured to execute the second capping during one or ones of the plurality of divided periods in which the counted number of times of reception of the recording command is not larger than a predetermined number of times, and is configured to execute the first capping during the other of the plurality of divided periods. Since the first capping is executed by using the support surface, there is a case where the first capping exhibits a lower performance for preserving the liquid in the vicinity of the ejection openings, than the second capping. Further, since the second capping requires the movement mechanism and the second capping mechanism to be controlled, there is a case where the length of time from release of the second capping to establishment of the recordable state is larger than a length of time from release of the first capping to establishment of the recordable state. Owing to this arrangement, the length of time required for starting a recording operation can be reduced in the period in which the recording command is received highly frequently, and the drying of the liquid staying in the vicinity of the ejection openings can be effectively restrained in the period in which the recording command is not received highly frequently.

The controller may further include an initial-introduction detecting portion configured to detect whether or not the liquid has been initially introduced into each of at least one liquid ejection head. It is preferable that the controller is configured to execute the second capping at least until the initial introduction is detected by the initial-introduction detecting portion. Since the first capping is executed by using the support surface, there is a case where the first capping exhibits a lower performance for preserving the liquid in the vicinity of the ejection openings, than the second capping. By executing the second capping until the liquid has been initially introduced into the at least one liquid ejection head, it is possible to restrain drying of the liquid staying in the vicinity of the ejection openings and leakage of the liquid through the ejection openings.

The recording apparatus may further include a reverse conveying mechanism configured to reversely convey the recording medium (onto which an image has been recorded by ejection of the liquid from the at least one liquid ejection head toward the recording medium) to the conveying mechanism, while inverting the recording medium so as to cause top and bottom faces of the recording sheet to face downwardly and upwardly, respectively. It is preferable that the capping executing portion is configured to first execution in a period since the recording sheet has been conveyed from the conveying mechanism to the reverse conveying mechanism until the recording sheet has been reversely conveyed from the reverse conveying mechanism to the conveying mechanism. Owing to this arrangement, the first capping is executed also in the period in which the recording medium (having the top face onto which an image has been already recorded) is being reversely conveyed, thereby making it possible to restrain drying of the liquid staying in the vicinity of the ejection openings and also to restrain reduction of the throughput.

(14) The recording apparatus according to any one of modes (1)-(8), wherein the at least one liquid ejection head consists of a plurality of liquid ejection heads, wherein the controller further includes a partial-ejection-mode establishing portion configured to establish a partial ejection mode, such that an image is recorded onto the recording medium by only a part of the plurality of liquid ejection heads when the partial ejection mode is being established, and wherein the controller is configured to execute the second capping for at least one of the plurality of liquid ejection heads which is other than the part of the plurality of liquid ejection heads, when the partial ejection mode is being established.

The first capping is executed by causing the lip member to block or close a conveying path that is defined between the ejection surface and the support surface. Therefore, during the partial ejection mode in which an image is recorded onto a recording medium by only a part of the plurality of liquid ejection heads, the first capping cannot be executed for the other of the plurality of liquid ejection heads which are other than the part of the plurality of liquid ejection heads. In the recording apparatus according to this mode (14), the second capping is executed for the other of the plurality of liquid ejection heads, so that it is possible to restrain drying of the liquid staying in the vicinity of the ejection openings.

(15) The recording apparatus according to mode (14), wherein the controller is configured to execute the first capping for the part of the plurality of liquid ejection heads, when the partial ejection mode is being established.

Since the second capping requires the movement mechanism and the second capping mechanism to be controlled, there is a case where the length of time from release of the second capping to establishment of the recordable state is larger than a length of time from release of the first capping to establishment of the recordable state. In the recording apparatus according to this mode (15), during the partial ejection mode, the above-described part of the plurality of liquid ejection heads is subjected to the first capping upon reception of a command requesting execution of capping, so that it is possible to restrain drying of the liquid staying in the vicinity of the ejection openings and to reduce a length of time required for starting the recording operation.

(16) The recording apparatus according to mode (14) or (15), further includes:

a plurality of liquid reservoirs each of which is configured to supply the liquid to a corresponding one of the plurality of liquid ejection heads; and a liquid detector configured to detect that an amount of the liquid reserved in each of the plurality of liquid reservoirs is larger than a predetermined amount, wherein the partial-ejection-mode establishing portion is configured to establish the partial ejection mode, such that the image is recorded onto the recording medium by only at least one of the plurality of liquid ejection heads to each of which the liquid is supplied from a corresponding one of the plurality of liquid reservoirs that stores the liquid, whose amount is larger than the predetermined amount according to detection made by the liquid detector.

In the recording apparatus according to this mode (16), an image can be recorded by using the above-described at least one of the liquid ejection heads which is other than a part of the liquid ejection heads to each of which the liquid is supplied from a corresponding one of the liquid reservoirs in which the reserved liquid is not larger than the predetermined amount. Further, until the liquid reservoir is filled with the liquid or is replaced by another liquid reservoir, it is possible to restrain drying of the liquid staying in the vicinity of the ejection openings of the liquid ejection head to which the liquid is to be supplied from the liquid reservoir that is to be filled with the liquid or is to be replaced by another liquid reservoir.

(17) The recording apparatus according to any one of modes (14)-(16), wherein the controller includes a preliminary-ejection controlling portion configured to control the at least one liquid ejection head, such that the liquid is preliminarily ejected through the ejection openings after the first capping has been released by the controller, and such that the liquid is preliminarily ejected through the ejection openings after the second capping has been released by the controller, and wherein the preliminary-ejection controlling portion is configured to cause the liquid to be preliminarily ejected through the ejection openings by an amount smaller after the second capping has been released by the controller, than after the first capping has been released by the controller.

In the recording apparatus according to this mode (17), it is possible to reduce the amount of the liquid that is to be ejected preliminarily after release of the second capping.

(18) The recording apparatus according to any one of modes (1)-(17), wherein the at least one annular-shaped lip member constitutes a part of the second capping mechanism as well as a part of the first capping mechanism, and wherein the second capping mechanism is configured to execute the second capping that causes the ejection surface of each of the at least one liquid ejection head to be covered with a corresponding one of the at least one annular-shaped lip member and a corresponding one of the at least one movable member that is positioned in the opposed position.

In the recording apparatus according to this mode (18), the part of the second capping mechanism can be constituted by the at least one annular-shaped lip member as at least one member that is common to the first and second capping mechanisms, so that the construction of the second capping mechanism can be simplified.

(19) The recording apparatus according to mode (2)-(18), further includes a lip-member driving mechanism configured to move each of the at least one annular-shaped lip member relative to a corresponding one of the at least one liquid ejection head, wherein the second capping mechanism includes a movable-member driving mechanism configured to move each of the at least one movable member between the opposed position and the retracted position, wherein the controller is configured to control the lip-member driving mechanism when the first capping is released to establish a liquid ejectable state in which the liquid is ejectable from the at least one liquid ejection head toward the recording medium, wherein the controller is configured to control the lip-member driving mechanism, the movable-member driving mechanism and the movement mechanism when the second capping is released to establish the liquid ejectable state, and wherein a length of time from release of the first capping to establishment of the liquid ejectable state is smaller than a length of time from release of the second capping to establishment of the liquid ejectable state.

In the recording apparatus according to this mode (19), the first capping can be selected to be executed when a higher priority is given to improvement of throughput rather than to improvement of performance of preservation of the liquid in the ejection head, and the second capping can be selected to be executed when a higher priority is given to the improvement of the performance of the liquid preservation rather than the improvement of the throughput.

As is clear from the above description, in the recording apparatus constructed according to the present invention, one of the first and second cappings can be suitably selected, and the suitably selected one of the cappings can be executed.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE EMBODIMENTS

There will be described embodiments of the present invention, with reference to the drawings.

Figure 1:
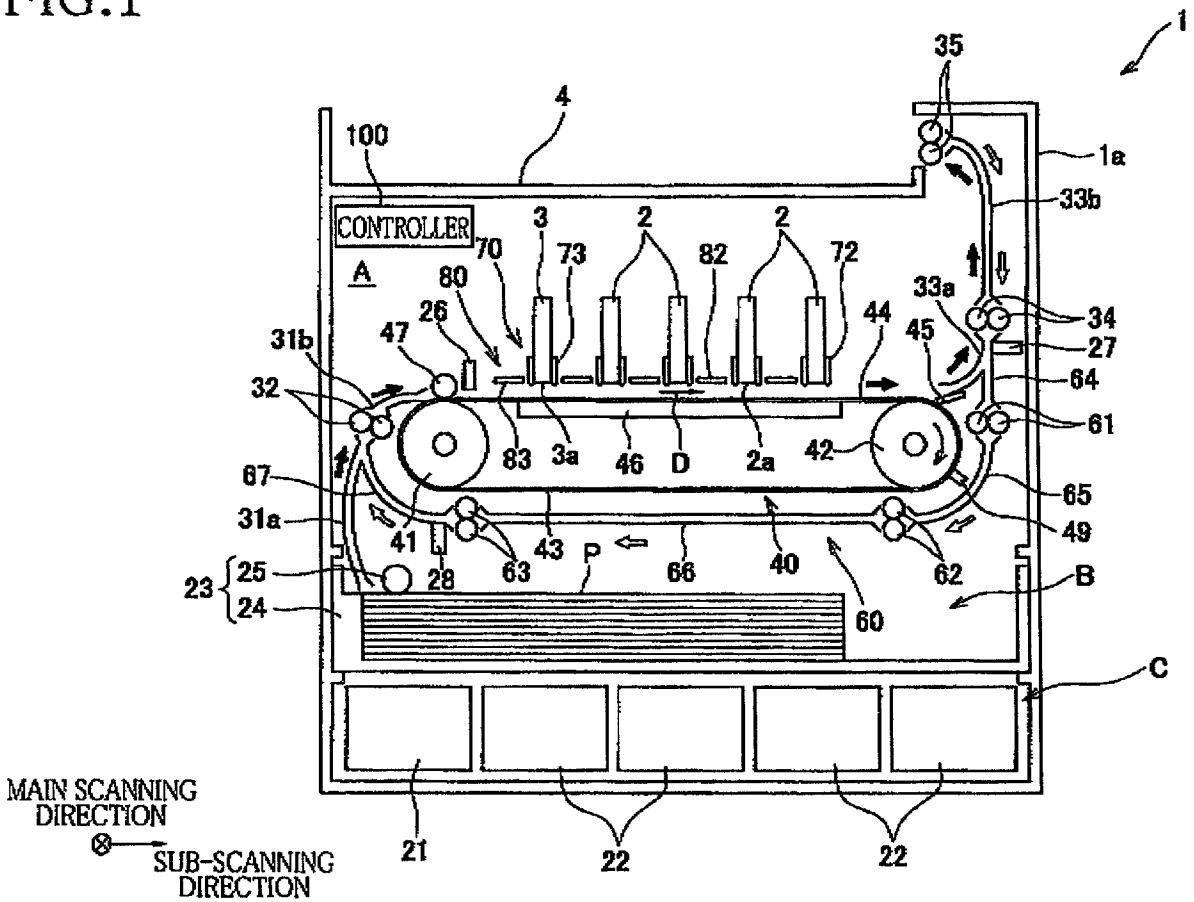
FIG. 1 is a schematic side view showing an overall construction of an inkjet printer constructed according to a first embodiment of the present invention.
Figure 2:
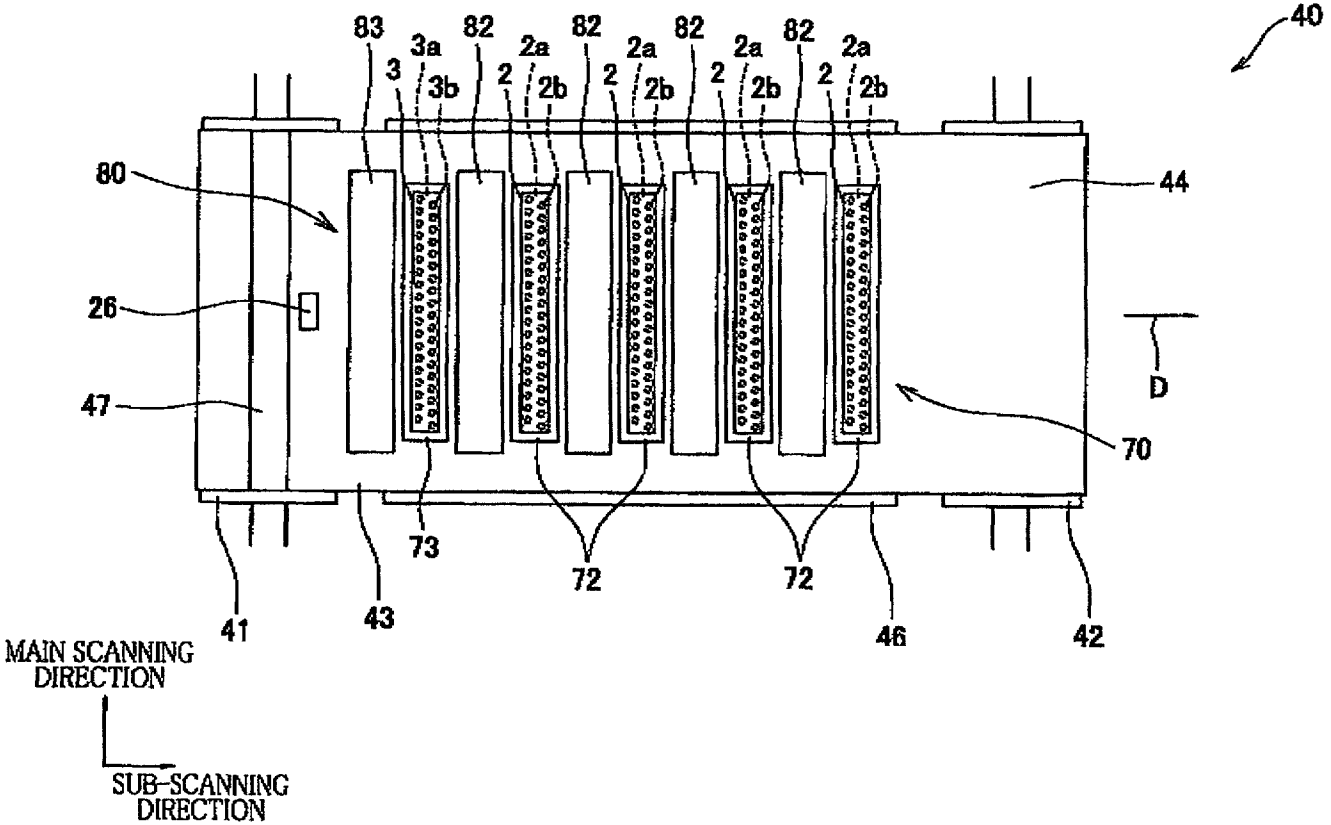
FIG. 2 is a schematic plan view showing heads and a conveying unit that are included in the inkjet printer of FIG. 1.

Referring first to FIGS. 1 and 2, there will be described an overall construction of an inkjet printer 1 as a recording apparatus that is constructed according to a first embodiment of the invention.

As shown in FIG. 1, the printer 1 has a generally rectangular parallelepiped-shaped housing body 1*a*. A sheet exit portion 4 is provided on a top plate of the housing body 1*a*. An inner space within the housing body 1*a* is sectioned into three space sections A, B, C that are arranged in this order of description as seen from top to bottom. In the space section A, there are provided four inkjet heads 2 that are respectively assigned to eject inks of magenta, cyan, yellow and black, a precoating head 3 that is assigned to eject a precoating liquid for aggregating or precipitating coloring components of the inks, a conveying unit 40 as a conveying mechanism and a reverse conveying unit 60 (as a reverse conveying mechanism). In the space section A, there are further provided first and second capping mechanisms 70, 80 configured to cap or cover the heads 2, 3. In the space section B, there is provided a sheet supply unit 23. In the space section C, there are detachably provided a plurality of liquid reservoirs in the form of a precoating-liquid tank 21 reserving therein the precoating liquid and four ink tanks 22 reserving therein the inks. The printer 1 further includes a controller 100 configured to control activations of the heads 2, 3 and other components of the printer 1.

The four tanks 22 reserve therein the inks of magenta, cyan, yellow and black, and the ink reserved in each tank 22 is supplied to the corresponding head 2 via a tube (not shown). The tank 21 reserves therein the precoating liquid, and the precoating liquid reserved in the tank 21 is supplied to the head 3 via a tube (not shown). In general, a precoating liquid aggregating pigment particles is used for a pigment-based ink, while a precoating liquid precipitating dye particles is used for a dye-based ink. The precoating liquid may be made of a suitably selected material such as liquid containing cationic polymer and multivalent metal salt (e.g., magnesium salt). When the ink lands on a region of a paper sheet P onto which the precoating liquid has been applied in advance, the multivalent metal salt or the like reacts with dye or pigment as coloring agent of the ink whereby hardly soluble or insoluble metal complex is formed as a result of the aggregation or precipitation. The housing body 1*a* is provided with a plurality of liquid detectors in the form of five sensors 91 (see FIG. 4) each of which is provided for detecting an amount of the liquid reserved in a corresponding one of the tanks 21, 22. Each of the sensors 91 is configured to output a detection signal when the detected amount of the liquid (reserved in the corresponding one of the tanks 21, 22) is not larger than a given amount. The detection signal outputted by each sensor 91 is supplied to the controller 100. The given amount, which may be set to 0 ml, for example, is an amount which requires the tank to be replaced by a new tank, or which requires the tank to be filled with the liquid.

The printer 1 has pumps 20 (see FIG. 4) each of which is provided in a midway portion of a corresponding one of the tubes interconnecting a corresponding one of the heads 2,3 and a corresponding one of the tanks 21, 22. The pumps 20 are activated by the controller 100 whereby the inks and the precoating liquid are supplied from the tanks 21, 22 to the heads 2, 8. When not being activated, each of the pumps 20 is configured to constitute a communication passage, such that a corresponding one of the heads 2, 3 and a corresponding one of the tanks 21, 22 are brought into communication with each other via the communication passage and a corresponding one of the tubes.

As shown in FIG. 2, the four heads 2, 8, which are identical in construction with one another, extend in a main scanning direction so as to be parallel to one another, and are arranged at a constant interval in a sub-scanning direction. The head 3 is disposed on an upstream side, as viewed in a conveying direction D, of the four heads 2. Among the four heads 2, the black-ink head 2 assigned to eject the black ink is disposed on an upstream side of the other three heads 2 in the conveying direction D. The heads 2, 3 have respective lower surfaces which are opposed to a conveyor belt 43 and which constitute respective ejection surfaces 2*a*, 3*a* in which a plurality of ejection openings 2*b*, 3*b* are defined, as shown in FIG. 2. That is, the printer 1 is a line-type color inkjet printer in which ink droplets are to be ejected via the plurality of ejection openings 2*b* that are arranged in the main scanning direction. It is noted that the sub-scanning direction is a direction parallel to the conveying direction D in which the paper sheet P is to be conveyed by the conveying unit 40, and that the main scanning direction is a direction which is parallel to a horizontal plane and which is perpendicular to the sub-scanning direction.

In the inkjet printer 1, there are defined a sheet conveying path and a sheet reverse-conveying path. The sheet conveying path is a path along which the sheet P is to be conveyed, as indicated by thick arrows (black arrows) in FIG. 1, from the sheet supply unit 23 to the sheet exit portion 4. The sheet reverse-conveying path is a path along which the sheet P that has been conveyed along the sheet conveying path is to be conveyed as indicated by white arrows in FIG. 1.

The sheet supply unit 23 has a sheet supply cassette 24 as a recording-medium storage and a sheet supply roller 25. The sheet supply cassette 24 is removably attached to the housing body 1*a*, and is constituted by a box having an upper opening and capable of storing therein a plurality of paper sheets P. The sheet supply roller 25 is to be rotated, under control by the controller 100, for supplying an uppermost one of the sheets P stacked in the sheet supply cassette 24. The housing body 1*a* is provided with a recording-medium detector in the form of a sensor 92 (see FIG. 4) that is configured to detect whether there is a sheet P or not in the sheet supply cassette 24. When no sheet P is present in the sheet supply cassette 24, the sensor 92 outputs a detection signal indicative of absence of the sheet P in the cassette 24, and the outputted signal is supplied to the controller 100. The housing body 1*a* is provided further with a storage disposition detector in the form of a sensor 93 (see FIG. 4) that is configured to detect whether the sheet supply cassette 24 is disposed in a sheet supplying position. The sheet supply cassette 24 is normally disposed in the sheet supplying position, as shown in FIG. 1, which enables the sheet P to be supplied from the sheet supply cassette 24 toward the conveying unit 40. When the sheet supply cassette 24 is not disposed in the sheet supplying position, the sensor 93 outputs a detection signal indicating that the sheet supply cassette 24 is not disposed in the sheet supplying position, and the outputted signal is supplied to the controller 100. It is noted that the signal indicating that the sheet supply cassette 24 is not disposed in the sheet supplying position is outputted when the cassette 24 has been removed from the housing body 1*a*, when the cassette 24 is being introducing into the housing body 1*a* and/or when the cassette 24 is being removed from the housing body 1*a*.

There are conveying guides 31*a*, 31*b* and a pair of conveying rollers 32 that are disposed on a left side of the conveying unit 40, as seen in FIG. 1. The conveying guides 31*a*, 31*b* extend curvedly from the sheet supply cassette 24 toward the conveying unit 40, and the pair of conveying rollers 32 are disposed between the conveying guides 31*a*, 31*b*. The sheet P, which has been supplied from the sheet supply tray 23 and passed the conveying, guide 31*a*, is conveyed, by the conveying rollers 32 that are rotated under control by the controller 100, toward the conveying unit 40 via the conveying guide 31*b*.

As shown in FIGS. 1 and 2, the conveying unit 40 has: belt pulleys 41, 42; a conveyor belt 43 which is constituted by an endless belt and which is looped around the two belt pulleys 41, 42; a nip roller 47 disposed outside the conveyor belt 43; a separator plate 45 disposed outside the conveyor belt 43; and a suction platen 46 disposed inside the conveyor belt 43. The belt pulley 42 is a driving pulley that is to be rotated in a clockwise direction as seen in FIG. 1, under control by the controller 100. The conveyor belt 43 has a support surface 44 that is opposed to the ejection surfaces 2*a*, 3*a*. With rotation of the belt pulley 42, an opposed portion of the surface 44, which is opposed to the heads 2, 3, is caused to run in the conveying direction D. The belt pulley 41 is a driven pulley, which is to be rotated in the clockwise direction as seen in FIG. 1, as a result of circulation of the conveyor belt 43.

The conveyor belt 43 is made of, for example, polyimide or fluorocarbon resin, and has a certain degree of flexibility and a specific volume resistance of about $10^8$-$10^{14}$ Ωcm. As long as the belt 43 has such a degree of flexibility and such a specific volume resistance, the belt 43 may be made of any other material. The surface 44 of the belt 43 is a generally smoothed surface. The specific volume resistance of about $10^8$-$10^{14}$ Ωcm and the smoothness of the surface 44 facilitate the sheet P to be sucked onto the surface 44 so as to be conveyed by the conveyor belt 43. That is, the conveyor belt 43 is made of a material that is suitable for conveyance of the sheet P with the sheet P being sucked onto the surface 44 owing to static electricity, and is given a shape suitable for such a conveyance.

The suction platen 46 has a pair of comb-teeth-like electrodes (not shown) each of which has a plurality of elongated portions elongated in the conveying direction D, such that the elongated portions of the respective comb-teeth-like electrodes are arranged alternately in the main-scanning direction. With application of an electric voltage between the comb-teeth-like electrodes, the sheet P positioned above the suction platen 46 can be sucked onto the surface 44 of the conveyor belt 43. It is noted that the electric voltage is applied to the suction platen 46 by a power supply (not shown) that is to be controlled by the controller 100.

The nip roller 47 is disposed in a position that is opposed to the belt pulley 41, and is constantly forced by an elastic member such as a spring toward the surface 44 so as to press the sheet P (that has been supplied from the sheet supply tray 23) against the surface 44. The nip roller 47 is a driven roller that is to be rotated as a result of circulation of the conveyor belt 43. Between the nip roller 47 and the head 3, a sheet detection sensor 26 is provided to detect the sheet P pressed by the nip roller 47 against the surface 44. The sheet detection sensor 26 outputs a detection signal indicative of detection of the sheet P, and the outputted signal is supplied to the controller 100.

The conveyor belt 43 is caused to run, i.e., circulated by rotation of the belt pulley 42 in the clockwise direction (as seen in FIG. 1) under control by the controller 100. In this instance, the belt pulley 41 and the nip roller 47 are also rotated as a result of the circulation of the conveyor belt 43. Further, in this instance, different levels of electric potentials are applied to the respective comb-teeth-like electrodes of the suction platen 46 under control by the controller 100, such that one of a positive electric charge and a negative electric charge is generated on an opposed portion of the conveyor belt 43 that is opposed to the sheet P while the other of the positive electric charge and the negative electric charge is induced on a surface of the sheet P opposed to the conveyor belt 43, whereby the sheet P is sucked onto the surface 44 of the conveyor belt 43, as a result of attraction of the opposite electric charges to each other. Thus, the sheet P having been supplied from the sheet supply tray 23 is conveyed in the conveyance direction D while being supported on the surface 44, so as to pass a position that is opposed to the ejection surfaces 2*a*, 3*a*.

When the sheet P, which is conveyed while being supported on the surface 44 of the conveyor belt 43, passes the position opposed to the ejection surfaces 2*a*, 3*a*, the heads 2, 3 are caused by the controller 100 to eject the precoating liquid and the inks of the respective colors toward the sheet P. The precoating liquid is ejected from the head 3 so as to be applied onto a region of the sheet P onto which a color image is to be recorded, and then the inks of the respective colors are ejected from the heads 4 so as to be applied to the above-described region of the sheet P onto which the precoating liquid has been applied, so that the desired color image is formed on the sheet P. In this instance, when droplets of the inks land on the precoating liquid having applied onto the sheet P, the coloring components of the inks are aggregated or precipitated by the precoating liquid, thereby making it possible to prevent the inks from bleeding on the sheet P. The separator plate 45 is disposed in a position opposed to the belt pulley 42, and serve to separate the sheet P from the surface 44 so as to guide the sheet P to be conveyed further in the conveying direction D.

As shown in FIG. 1, there are conveying guides 33*a*, 33*b* and conveying rollers 34, 35 that are located on a right side of the heads 2. These conveying guides 33*a*, 33*b* and conveying rollers 34, 35 cooperate to constitute a part of the reverse conveying unit 60. The conveying guides 33*a*, 83*b* are curved guides extending from the conveying unit 40 toward the sheet exit portion 4. The two pairs of the conveying rollers 34, 35 are to be controlled by the controller 100. A sheet detection sensor 27 is disposed in the vicinity of the pair of conveying rollers 34, and is configured to detect the sheet P that has been conveyed from the conveying unit 40. The sheet detection sensor 27 outputs a detection signal indicative of detection of the sheet P, and the outputted signal is supplied to the controller 100.

Thus, with rotations of the conveying rollers 34, 35 in predetermined directions under control by the controller 100, the sheet P having been conveyed from the conveying unit 40 is caused to pass the conveying guides 83*a*, 38*b* so as to be conveyed upwardly, and is caused to be eventually discharged to the sheet exit portion 4. On the other hand, when an image is to be formed on a bottom face of the sheet P (which is opposite to a top face having the image already recorded thereon) before the sheet P is discharged to the sheet exit portion 5, the controller 100 is configured, upon arrival of a trailing end portion of the sheet P in vicinity of the pair of conveying rollers 35, to control the two pairs of conveying rollers 34, 35 such that the conveying rollers 34, 35 are rotated in directions that are opposite to the above-described predetermined directions, whereby the sheet P is conveyed (downwardly as seen in FIG. 1) in a reverse direction as indicated by white arrows in FIG. 1.

As shown in FIG. 1, the reverse conveying unit 60 has the above-described conveying guides 33*a*, 33*b*, two pairs of conveying rollers 34, 35, three pairs of conveying rollers 61, 62, 63 and conveying guides 64, 65, 66, 67. The conveying guide 64 is disposed between the pair of conveying rollers 34 and the pair of conveying rollers 61, so as to guide the sheet P conveyed in the reverse direction. The conveying guide 65 is disposed between the pair of conveying rollers 61 and the pair of conveying rollers 62, so as to guide the sheet P conveyed in the reverse direction. The conveying guide 66 is disposed between the pair of conveying rollers 62 and the pair of conveying rollers 63, so as to guide the sheet P conveyed in the reverse direction. The conveying guide 87 is disposed between the pair of conveying rollers 63 and the pair of conveying rollers 32, and is combined with the conveying guide 31*a*. It is noted that the conveying rollers 61, 62, 63 are also controlled by the controller 100. A sheet detection sensor 28 is disposed in the vicinity of the pair of conveying rollers 63, and is configured to detect the sheet P that has been conveyed by the reverse conveying unit 60. The sheet detection sensor 28 outputs a detection signal indicative of detection of the sheet P, and the outputted signal is supplied to the controller 100.

The three pairs of conveying rollers 61, 62, 63 of the reverse conveying unit 60 are rotated under control by the controller 100, whereby the sheet P (having been conveyed in the reverse direction away from the sheet exit portion 4) is conveyed along the conveying guides 64, 65, 66, 67 toward the pair of conveying rollers 32. Then, the pair of conveying rollers 32 are rotated under control by the controller 100, whereby the sheet P (with the top face having the image recorded thereon) is conveyed to the upstream side, as viewed in conveying direction D, of the conveying unit 40. In this instance, when the sheet P is conveyed to the conveying unit 40, the sheet P is inverted such that the bottom face faces upwardly while the top face (that used to face upwardly when the sheet P had been supplied from the sheet supply tray 23) faces downwardly.

The printer 1 is provided with a vertical movement mechanism in the form of a head elevator mechanism 95 (see FIG. 4) that is configured to vertically move the five heads 2, 3. The head elevator mechanism 95 is to be controlled by the controller 100 so as to upwardly or downwardly move a selected one or ones of the heads 2, 3, such that each of the heads 2, 3 is movable between a printing position (see FIG. 1) and a separated or distant position (see FIG. 3B). The printing position is a position of each of the heads 2, 3 relative to the conveyor belt 43 in a recordable state in which an image can be recorded onto the sheet P by causing the each of the heads 2, 3 to eject the precoating liquid or inks toward the sheet P. The recordable state is a state in which the ejection surface of each of the heads 2, 3 is opposed to the surface 44 of the conveyor belt 43 with a given distance between the ejection surface and the surface 44. The given distance is a distance which avoids contact of the top face of the sheet P with the ejection surface and which enables the ejected liquid to land onto accurate positions, namely, is a distance suitable for carrying out an image recording operation. On the other hand, the distant position is a position of each of the heads 2, 3 relative to the conveyor belt 43 in a separated or distant state in which a corresponding one of the ejection surfaces 2*a*, 3*a* is distant from the surface 44 by a distance larger than the above-described given distance. When each of the heads 2, 3 is moved by the head elevator mechanism 95 to be positioned in the distant position, the each of the heads 2, 3 and the conveying unit 40 cooperate with each other to define therebetween a space in which a corresponding one of plate-like members 82, 83 can be positioned. Each of the plate-like members 82, 83, which is normally positioned in a retracted position that is offset from the above-described space in the sub-scanning direction, can be positioned in an opposed position when a corresponding one of the heads 2, 3 is positioned in the distant position. When being positioned in the opposed position within the above-described space, each of the plate-like members 82, 83 is opposed to a corresponding one of the ejection surfaces 2*a*, 3*a* of the heads 2, 3.

Figure 3A:
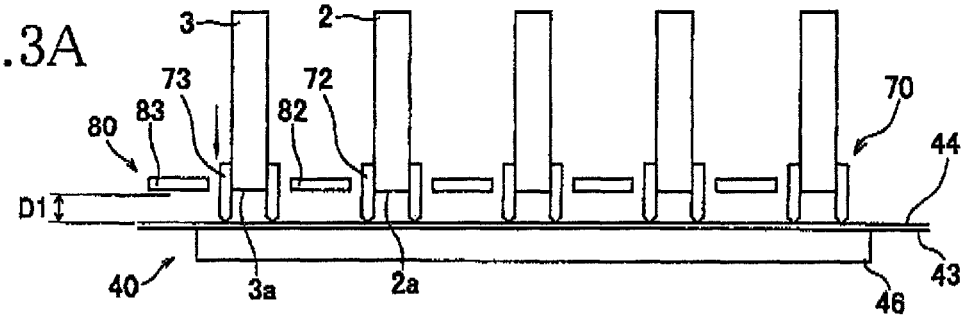
FIGS. 3A-3D are views showing executions of first and second cappings.
Figure 3B:
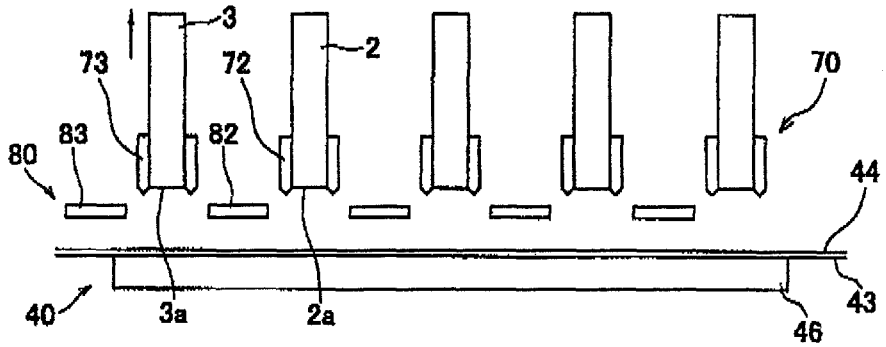
Figure 3C:
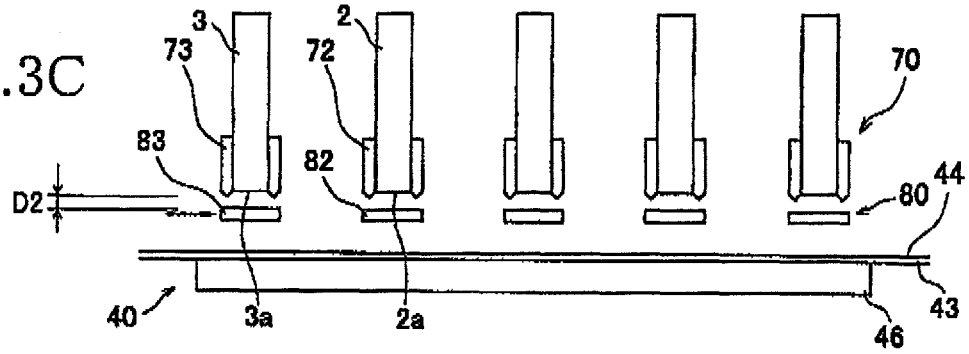

As shown in FIGS. 1 and 2, the first capping mechanism 70 has four tubular-shaped or annular-shaped lip members 72 provided for the respective four inkjet heads 2; an tubular-shaped or annular-shaped lip member 73 provided for the precoating head 3; and a lip-member driving mechanism 75 (see FIG. 4) configured to move the lip members 72, 73. Each of the lip members 72, 73, which are identical in construction with one another, is disposed to surround a corresponding one of the heads 2, 3, and is held at only an upper end portion of an inner circumferential surface thereof with an outer circumferential surface of the corresponding one of the heads 2, 3. Each of the lip members 72, 73 has a lower end portion that is made of an elastic member such as a rubber. The five annular-shaped lip members 72, 73 are selectively movable relative to the respective five heads 2, 3 by the lip-member driving mechanism 75 under control by the controller 100, so that a selected one or ones of the lip members 72, 73 can be caused to slide on a corresponding one or ones of the heads 2, 3. Each of the lip members 72, 73 is vertically movable by the lip-member driving mechanism 75, so as to be positioned in a selected one of a non-contact position, a first contact position and a second contact position relative to a corresponding one of the heads 2, 8. When each of the lip members 72, 73 is positioned in the non-contact position, a lower end of the each of the lip members 72, 73 is separated from the surface 44 and a corresponding one of the plate-like members 82, 88, as shown in FIGS. 1, 3B and 3C. When each of the lip members 72, 73 is positioned in the first contact position, the lower end of the each of the lip members 72, 73 is in contact with the surface 44, as shown in FIG. 8A. When each of the lip members 72, 73 is positioned in the second contact position, the lower end of the each of the lip members 72, 73 is in contact with a corresponding one of the plate-like member 82, 83 that is positioned, in the opposed, position.

Each of the lip members 72, 73 is moved from the non-contact position to the first contact position by activation of the lip-member driving mechanism 75 under control by the controller 100, while a corresponding one of the heads 2, 3 is positioned in the printing position. When each of the lip members 72, 78 is positioned in the non-contact position, a corresponding one of the ejection surfaces 2*a*, 8*a* is not covered with the each of the lip members 72, 73 and the surface 44. On the other hand, when each of the lip members 72, 78 is positioned in the first contact position, a corresponding one of the ejection surfaces 2*a*, 8*a* is covered by cooperation of the each of the lip members 72, 73 and the surface 44, as shown in FIG. 3A. The first contact position is a position in which each of the lip members 72, 73 is to be brought into contact at its lower end with the surface 44, by its downward movement from the non-contact position relative to a corresponding one of the heads 2, 3 by a distance D1 (see FIG. 3A). In this instance, since the upper end portion of the inner circumferential surface of each of the lip members 72, 73 is also in contact with the outer circumferential surface of a corresponding one of the heads 2, 3, so that a space (i.e., exterior space held in communication with the ejection openings of the corresponding one of the heads 2, 3), which is surrounded by a corresponding one of the ejection surfaces 2*a*, 3*a*, the surface 44 of the conveyor belt 48 and the each of the lip members 72, 73, constitutes an enclosed space. Each of the five ejection surfaces 2*a*, 3*a* is covered with a corresponding one of the lip members 72, 73 and the surface 44 of the conveyor belt 43, namely, is subjected to a first capping, whereby the each of the ejection surfaces 2*a*, 3*a* is sealed so as to restrain increase of viscosity of the liquid in the vicinity of each of the ejection openings 2*b*, 3*b* of the heads 2, 3. The first capping of each of the ejection surfaces 2*a*, 3*a* is released by movement of a corresponding one of the lip members 72, 73 from the first contact position to the non-contact position by activation of the lip-member driving mechanism 75 under control by the controller 100. Each of the five lip members 72, 73 can be positioned, by the lip-member driving mechanism 75 under control by the controller 100, in a selected one of the above-described non-contact position, first contact position and second contact position relative to a corresponding one of the heads 2, 3. It is noted that each of the five lip members 72, 73 is positionable in a selected one of the above-described non-contact position and first contact position by the lip-member driving mechanism 75 under control by the controller 100. It is further noted that the term "first capping" may be referred also to as either "first capping action" or "first capping state", such that each of the ejection surfaces 2*a*, 3*a* is covered with a corresponding one of the lip members 72, 73 and the surface 44 of the conveyor belt 43, with an enclosed space being constituted by the space surrounded by cooperation of the each of the ejection surfaces 2*a*, 3*a*, the corresponding one of the lip members 72, 73 and the surface of the conveyor belt 43, as a result of execution of the first capping action or establishment of the first capping state.

Figure 3D:
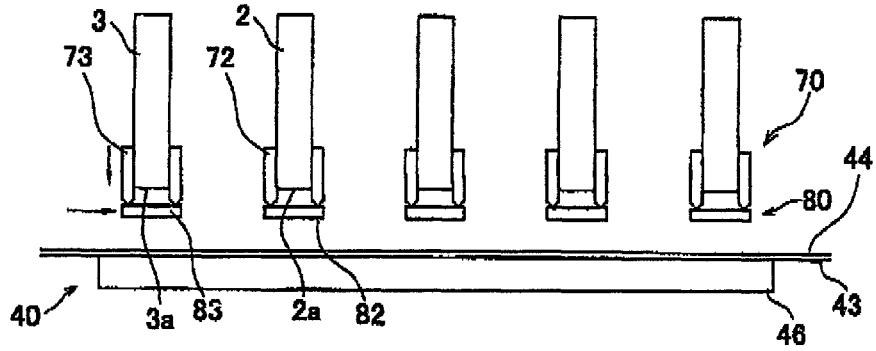

As shown in FIGS. 1 and 2, the second capping mechanism 80 has: the above-described plate-like members 82, 83 (each serving as a movable member) and a movable-member driving mechanism 85 (see FIG. 4), in addition to the lip members 72, 78 and lip-member driving mechanism 75 which cooperate to constitute also the first capping mechanism 70. Each of the four plate-like members 82 is disposed on a left side of a corresponding one of the four heads 2 as seen in FIGS. 1 and 2. The plate-like member 83 is disposed on a left side of the head 3 as seen in FIGS. 1 and 2. The movable-member driving mechanism 85 is configured to move each of the plate-like members 82, 83. The plate-like members 82, 83 are substantially identical in construction with one another. Each of the plate-like members 82, 83 has an upper surface which is smoothed and which has a size slightly larger than a corresponding one of the ejection surfaces 2*a*, 3*a*. Each of the plate-like members 82, 83 is made of a metal or glass plate having a higher gas-barrier property than the conveyor belt 43. The five plate-like members 82, 83 are selectively movable relative to the respective five heads 2, 3 by the movable-member driving mechanism 85 under control by the controller 100, so that a selected one or ones of the plate-like members 82, 83 can be caused to slide in the sub-scanning direction. Each of the plate-like members 82, 83 is horizontally movable between a retracted position and an opposed position, by the movable-member driving mechanism 85. When being positioned in the retracted position, each of the plate-like members 82, 83 is not opposed to a corresponding one of the ejection surfaces 2*a*, 3*a*, as shown in FIGS. 3A and 3B. When being positioned in the opposed position, each of the plate-like members 82, 83 is opposed to a corresponding one of the ejection surfaces 2*a*, 3*a*, as shown in FIGS. 3C and 3D.

In the inkjet printer 1 constructed as described above, each of the heads 2, 3 is movable between the printing position (as shown in FIG. 3A) and the distant position (as shown in FIG. 3B), by activation of the head elevator mechanism 95 under control by the controller 100. Each of the plate-like members 82, 83 is movable between the retracted position and the opposed position, by activation of the movable-member driving mechanism 85 under control by the controller 100. Each of the annular-shaped lip members 72, 73 is movable between the non-contact position and the second contact position. It is noted that a position of each of the lip members 72, 73 relative to a corresponding one of the heads 2, 3 when the each of the lip members 72, 73 and the corresponding one of the heads 2, 3 are positioned in the non-contact position and the distant position, respectively, is the same as a position of the each of the lip members 72, 73 relative to the corresponding one of the heads 2, 3 when the each of the lip members 72, 73 and the corresponding one of the heads 2, 3 are positioned in the non-contact position and the printing position, respectively. When each of the annular-shaped lip members 72, 73 is positioned in the non-contact position, a corresponding one of the ejection surfaces 2*a*, 3*a* is not covered with the each of the lip members 72, 73 and a corresponding one of the plate-like members 82, 83. On the other hand, when each of the annular-shaped lip members 72, 73 is positioned in the second contact position, a corresponding one of the ejection surfaces 2*a*, 3*a* is covered by cooperation of the each of the lip members 72, 73 and a corresponding one of the plate-like members 82, 83. The second contact position is a position in which each of the lip members 72, 73 is to be brought into contact at its lower end with a corresponding one of the plate-like members 82, 83, by its downward movement from the non-contact position relative to a corresponding one of the heads 2, 3 by a distance D2 (see FIG. 3C). Each of the five ejection surfaces 2*a*, 3*a* is covered with a corresponding one of the lip members 72, 73 and a corresponding one of the plate-like members 82, 83, namely, is subjected to a second capping, whereby the each of the ejection surfaces 2*a*, 3*a* is sealed so as to restrain increase of viscosity of the liquid in the vicinity of each of the ejection openings 2*b*, 3*b* of the heads 2, 3. It is noted that the term "second capping" may be referred also to as either "second capping action" or "second capping state", such that each of the ejection surfaces 2*a*, 3*a* is covered with a corresponding one of the lip members 72, 73 and a corresponding one of the plate-like members 82, 83, with an enclosed space being constituted by the space surrounded by cooperation of the each of the ejection surfaces 2*a*, 3*a*, the corresponding one of the lip members 72, 73 and the corresponding one of the plate-like members 82, 83, as a result of execution of the second capping action or establishment of the second capping state. The enclosed space, which is established by execution of the second capping, is defined by cooperation of each of the ejection surfaces 2*a*, 3*a* and a corresponding one of the lip members 72, 73 with a corresponding one of the plate-like members 82, 83, rather than with the conveyor belt 43, and accordingly exhibits a higher performance for preserving the liquid in the vicinity of the ejection openings, than the enclosed space established by execution of the first capping. That is, the degree of tightness of the enclosed space defined upon execution of the second capping is higher than the degree of tightness of the enclosed space defined upon execution of the first capping. Each of the plate-like members 82, 83 is a member that is employed exclusively for capping a corresponding one of the ejection surfaces 2*a*, 3*a*, and is made of a material suitable for establishing the enclosed space and is given a shape suitable for establishing the enclosed space. This is contrast to the conveyor belt 43 which is made of a material suitable for conveyance of the sheet P and is given a shape suitable for conveyance of the sheet P, as described above. Thus, each of the plate-like members 82, 83 has a higher gas-barrier property and a higher degree of surface smoothness, as compared with the conveyor belt 43.

The second capping of each of the ejection surfaces 2*a*, 3*a* is released by movement of a corresponding one of the lip members 72, 73 from the second contact position to the non-contact position by activation of the lip-member driving mechanism 75 under control by the controller 100. Thereafter, each of the plate-like members 82, 83 is moved from the opposed position to the retracted position by activation of the movable-member driving mechanism 85 under control by the controller 100, and then each of the heads 2, 3 is returned from the distant position to the printing position by activation of the head elevator mechanism 95 under control by the controller 100. Each of the plate-like members 82, 83 can be positioned, by the movable-member driving mechanism 85 under control by the controller 100, in a selected one of the above-described retracted position and opposed position relative to a corresponding one of the heads 2, 3. When the first capping state is switched to a liquid ejectable state in which the liquid is ejectable from the heads 2, 3 toward the sheet P, the lip-member driving mechanism 75 is activated. When the second capping state is switched to the liquid ejectable state, the lip-member driving mechanism 75, movable-member driving mechanism 85 and head elevator mechanism 95 are activated. Therefore, a length of time required for establishing the liquid ejectable state from the first capping state is smaller than that required for establishing the liquid ejectable state from the second capping state.

As shown in FIG. 1, the printer 1 is provided with a wiper blade 49, which is disposed in a position located on one of opposite sides of the conveyor belt 43 that is remote from the belt pulley 42. The blade 49 has a length that is slightly larger than a width of the conveyor belt 43 as measured in the main scanning direction, and is constantly held in contact with the conveyor belt 43 over an entire width of the belt 43. Owing to this construction, foreign substances such as ink can be wiped by the blade 49 from the surface 44 of the conveyor belt 43, by rotation of the conveyor belt 43. It is noted that the wiped foreign substances are discarded to a waste portion (not shown) that is disposed within the housing body IA.

Figure 4:
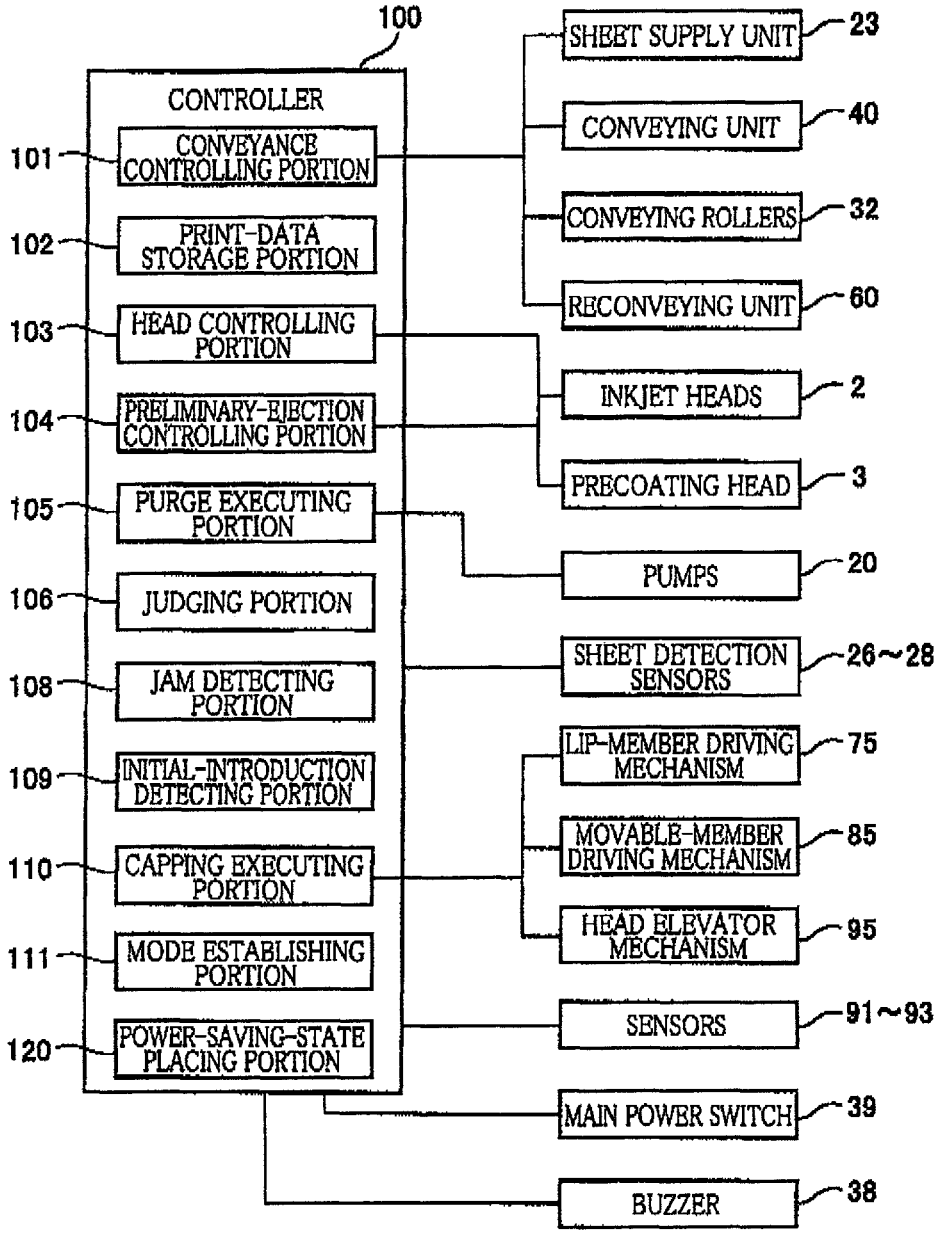
FIG. 4 is a block diagram showing construction of a controller included in the inkjet printer of FIG. 1.

Referring next to FIG. 4, the controller 100 (switching means) will be described. The controller 100 includes CPU (Central Processing Unit), EEPROM (Electrically Erasable and Programmable Read Only Memory) storing programs (that are to be executed by the CPU) and data (that are to be used in the execution of the programs) such that the stored programs and data are rewritable, and RAM (Random Access Memory) temporarily storing the data in the execution of the programs. The controller 100 is constituted by various functional portions that are established by cooperations of these hardwares with softwares stored in the ROM. As shown in FIG. 4, the controller 100 is configured to control an entirety of the printer 1, and includes a conveyance controlling portion 101, a print-data storage portion 102, a head controlling portion 103, a preliminary-ejection controlling portion 104, a purge executing portion 105, a judging portion 106, a jam detecting portion 108, an initial-introduction detecting portion 109, a capping executing portion 110 and a mode establishing portion 111.

The conveyance controlling portion 101 is configured to control the sheet supply tray 23, conveying rollers 32, conveying unit 40 and reverse conveying unit 60, based on conveyance data included in the print data stored in the print-data storage portion 102, such that the sheet P is conveyed to the sheet exit portion 4 via the sheet conveying path and sheet reverse-conveying path. It is noted that, when an image is to be recorded onto only one-side face of the sheet P, the sheet P is conveyed to the sheet exit portion 4 via the sheet conveying path. When an image is to be recorded onto each of both-side faces of the sheet P, the sheet P is conveyed to the sheet exit portion 4 via the sheet conveying path and the sheet reverse-conveying path.

The print-data storage portion 102 stores therein the print data which is transmitted from an external device such as PC (Personal Computer) and which includes the conveyance data and image data. The image data is data which is indicative of an image that is to be recorded onto the sheet P and which includes ejection data relating to ejection of the liquid from the heads 2, 3. It is noted that, in the present embodiment, the ejection data includes a precoating-liquid-related portion relating to ejection of the precoating liquid. The precoating-liquid-related portion of the ejection data is determined based on the image data. Specifically described, the precoating-liquid-related portion of the ejection data is determined such that the precoating liquid is caused to land on a dot region on which the ink (ejected from the heads 2 based on the image data) is to land. That is, the precoating liquid is ejected to land on the region on which an image is to be recorded, without landing on a region on which an image is not to be recorded.

The head controlling portion 103 is configured to control ejection of the liquid from the heads 2, 3 such that the liquid is ejected toward the sheet P, in accordance with the ejection data stored in the print-data storage portion 102. In this instance, the head controlling portion 103 controls each of the heads 2, 3 such that the ejection of the precoating liquid or inks toward the sheet P is caused to start when a given length of time has passed since detection of a leading end of the sheet P. The given length of time is a length of time that is obtained by dividing a certain distance by a velocity of conveyance of the sheet P, wherein the certain distance is a distance between an upstreammost one of the ejection openings (not shown) of each of the heads 2, 3 and the leading end of the sheet P upon detection of the leading end of the sheet P by the sheet detection sensor 26.

The mode establishing portion 111 is configured to establish one of first and second ejection modes, by storing therein the one of the first and second ejection modes which is selected in accordance with a setting operation carried out by the user. The first ejection mode is a mode for causing the liquid to be ejected through the ejection openings 2*b*, 3*b* by an amount determined for the first ejection mode, for a length of time determined for the first ejection mode, for the purpose of maintaining the ejection openings 2*b*, 3*b*. The second ejection mode is a mode for causing the liquid to be ejected through the ejection openings 2*b*, 3*b* by an amount determined for the second ejection mode, for a length of time determined for the second ejection mode, for the purpose of maintaining the ejection openings 2*b*, 3*b*. The amount and the length of time of the liquid ejection during the second ejection mode are smaller than those during the first ejection mode. That is, in the first ejection mode, the amount of the liquid (i.e., precoating liquid and inks) to be ejected for maintaining the ejection openings 2*b*, 3*b* is large, but a length of time required for establishing the liquid ejectable state (i.e., a state in which the precoating liquid and inks can be ejected toward the recording medium) from the first capping state (i.e., a state in which the ejection surfaces 2*a*, 3*a* are capped) is small. On the other hand, in the second ejection mode, the amount of the liquid precoating liquid and inks) to be ejected for maintaining the ejection openings 2*b*, 3*b* is small, but a length of time required for establishing the liquid ejectable state (i.e., a state in which the precoating liquid and inks can be ejected toward the recording medium) from the second capping state (i.e., a state in which the ejection surfaces 2*a*, 3*a* are capped) is large. The user selects the second ejection mode where he or she prefers to restrain the amount of the consumption of the precoating liquid and inks rather than to improve the throughput, and selects the first ejection mode where he or she prefers to improve the throughput rather than to restrain the amount of the consumption of the precoating liquid and inks. That is, a sum of the time required for switching from the first capping to the liquid ejectable state and the ejection time determined for the first ejection mode is smaller than a sum of the time required for switching from the second capping to the liquid ejectable state and the ejection time determined for the second ejection mode. It is noted that the first ejection mode is established when neither the first ejection mode nor the second ejection mode is being particularly selected by the user.

The preliminary-ejection controlling portion 104 is configured to control the heads 2, 3 such that the liquid is preliminarily ejected toward the surface 44 of the conveyor belt 43 after the first or second capping is released by the capping executing portion 110 and before the liquid is ejected toward the sheet P by the head controlling portion 103. In this instance, when the first ejection mode is being established by the mode establishing portion 111 (namely, when the first ejection mode is being stored in the mode establishing portion 111), the preliminary-ejection controlling portion 104 controls the heads 2, 3 such that the liquid is ejected from each of the heads 2, 3 by an ejection amount determined for the first ejection mode, for a length of ejection time determined for the first ejection mode. When the second ejection mode is being established by the mode establishing portion 111, the preliminary-ejection controlling portion 104 controls the heads 2, 3 such that the liquid is ejected from each of the heads 2, 3 by an amount smaller than that determined for the first ejection mode, for a length of time smaller than that determined for the first ejection mode. Specifically described, the preliminary-ejection controlling portion 104 causes the heads 2, 3 to be activated for a smaller length of time when the second ejection mode is being established, than when the first ejection mode is being established. The above-described length of ejection time is a length of time from start of the preliminary ejection to completion of the preliminary ejection. The above-described ejection amount is an amount of the liquid that is to be ejected for maintaining the ejection openings 2*b*, 3*b* of each of the beads 2, 3 (i.e., for maintaining suitable formation of meniscus in each of the ejection openings 2*b*, 3*b*). The amount of the liquid preliminarily ejected from each of the heads 2, 3 is smaller when the second ejection mode is being established, than when the first ejection mode is being established. However, since the preserving performance of the second capping is higher than that of the first capping, it is possible to obtain substantially the same performance in the second ejection mode as in the first ejection mode, although the amount of the preliminary ejection of the liquid is smaller in the second ejection mode than in the first ejection mode. Owing to the preliminary-ejection controlling portion 104 as described above, the preliminary ejection is carried out in a manner dependent on the established ejection mode, whereby the ejection openings 2*b*, 3*b* can be effectively recovered. It is noted that the preliminary ejection is an ejection of the liquid from the heads 2, 3 prior to an image recording that is to be carried out based on print data, and that the preliminary ejection is carried out without based on the print data.

The preliminary-ejection controlling portion 104 may be modified as needed. For example, the preliminary-ejection controlling portion 104 may be configured to control the heads 2, 3 such that the liquid is preliminarily ejected toward the surface 44 of the conveyor belt 43, by the ejection amount determined for the first ejection mode, for the length of ejection time determined for the first ejection mode, after the first capping is released by the capping executing portion 110 and before the liquid is ejected toward the sheet P by the head controlling portion 103. Further, the preliminary-ejection controlling portion 104 may be configured to control the heads 2, 3 such that the liquid is preliminarily ejected toward the surface 44 of the conveyor belt 43, by the ejection amount which is determined for the second ejection mode and which is smaller than the above-described ejection amount determined for the first ejection mode, for the length of ejection time which is determined for the second ejection mode and which is smaller than the above-described second ejection mode, after the second capping is released by the capping executing portion 110 and before the liquid is ejected toward the sheet P by the head controlling portion 103, so that it is possible to reduce the amount of the liquid consumed by the preliminary ejection carried out after release of the second capping. In these modifications, too, the ejection amount is an amount of the liquid that is to be ejected for maintaining the ejection openings 2*b*, 3*b* of each of the heads 2, 3 (i.e., for maintaining suitable formation of meniscus in each of the ejection openings 2*b*, 3*b*). Since the preserving performance of the second capping is higher than that of the first capping, it is possible to obtain substantially the same performance in the second ejection mode as in the first ejection mode, although the amount of the preliminary ejection of the liquid is smaller after release of the second capping than after release of the first capping.

The purge executing portion 105 is configured to cause the liquid to be forcedly discharged (i.e., ejected by purge execution) from each of the heads 2, 3 toward the surface 44 of the conveyor belt 43, by controlling a corresponding one of the pumps 20 which is provided for delivering the liquid to the each of the heads 2, 3, such that the liquid is forcedly discharged, each time a given period or length of time passes, when a printing operation is not being carried out. The above-described given period or length of time, which may be 20-30 days, for example, is a maximum period or length of time for which each of the heads 2, 3 is likely to be sufficiently maintained by only execution of the above-described preliminary ejection. In other words, it is considered that there is a possibility that each of the heads 2, 3 cannot be sufficiently maintained by only execution of the preliminary ejection when the above-described given period or length of time has passed without execution of the purge. When the first ejection mode is being established by the mode establishing portion 111, the purge executing portion 105 controls each of the pumps 20 such that the liquid is discharged from a corresponding one of the heads 2, 3 by an ejection amount determined for the first ejection mode. When the second ejection mode is being established by the mode establishing portion 111, the purge executing portion 105 controls each of the pumps 20 such that the liquid is discharged from a corresponding one of the heads 2, 3 by an ejection amount which is determined for the second ejection mode and which is smaller than the above-described ejection amount determined for the first ejection mode. Specifically described, the purge executing portion 105 causes each of the pumps 20 to be activated for a smaller length of time when the second ejection mode is being established than when the first ejection mode is being established. The above-described ejection amount is an amount of the liquid that is to be ejected for maintaining the ejection openings 2*b*, 3*b* of each of the heads 2, 3 (i.e., for discharging of the liquid staying in the vicinity of the ejection openings 2*b*, 3*b* and having an increased viscosity), and is different from the amount of the liquid that is to be ejected in the above-described preliminary ejection. Since the preserving performance of the second capping is higher than that of the first capping, it is possible to obtain substantially the same performance in the second ejection mode as in the first ejection mode, although the amount of the liquid discharged from each of the heads 2, 3 is smaller during the second ejection mode than during the first ejection mode. Owing to the purge executing portion 105 as described above, the purge is carried out in a manner dependent on the established ejection mode, whereby the ejection openings 2*b*, 3*b* can be effectively recovered.

The printer 1 may be modified to further include a pressure reducing mechanism (not shown) that is configured, during execution of the second capping, to reduce a pressure in the enclosed space formed by the second capping, when the liquid is to be forcedly ejected from each of the heads 2, 8. In this modification, the purge executing portion 105 is configured to control the pressure reducing mechanism for vacuuming the enclosed space, after controlling the lip-member driving mechanism 75, movable-member driving mechanism 85 and head elevator mechanism 95, for executing the second capping. In this modification, too, the ejection amount is substantially the same as that in the above-described embodiment, although the liquid is discharged from the heads 2, 3 owing to a different component, i.e., the pressure reducing mechanism that is not included in the above-described embodiment. Further, the purge executing portion 105 may be modified as needed. For example, the purge executing portion 105 may be configured to control each of the pumps 20 such that the liquid forcedly discharged from a corresponding one of the heads 2, 3 a given number of times for a certain period of time during the first ejection mode established by the mode establishing portion 111, and such that the liquid is forcedly discharged from the corresponding one of the heads 2, 3 another given number of times (that is smaller than the above-described given number of times) for the certain period of time during the second ejection mode established by the mode establishing portion 111. In other words, a length of time interval between each execution of the purge and the subsequent execution of the purge during the first ejection mode is larger than during the second ejection mode. For example, the purge executing portion 105 is configured to execute the purge once every 20 days during the first ejection mode established by the mode establishing portion 111, and is configured to execute the purge once every 30 days during the second ejection mode established by the mode establishing portion 111, so that an amount of the liquid discharged for the above-described certain period of time is smaller during the second ejection mode than during the first ejection mode.

The judging portion 106 is configured to determine, based on detection signals supplied from the five sensors 91 (i.e., liquid detectors) and sensors 92, 93, whether there is a possibility that no liquid is ejected from the heads 2, 3 toward the sheet P for a given length of time (i.e., a predetermined period of time). Described specifically, the judging portion 106 is configured, when the detection signal is outputted from at least one of the five sensors 91, to judge that there is a possibility that no liquid is ejected from a corresponding one or ones of the heads 2, 3 toward the sheet P for a given length of time. That is, the liquid is not ejected toward the sheet P, since an amount of the liquid reserved in a corresponding one or ones of the tanks 21, 22 is reduced to a threshold amount (predetermined amount) or less, until the corresponding one or ones of the tanks 21, 22 is filled with the liquid or is replaced by another tank or tanks. The replenishment or replacement of the one or ones of the tanks 21, 22 is carried out by the user. Therefore, it cannot be judged by the judging portion 106 whether the above-described given length of time is larger or smaller than a length of time from a point of time at which each of the tanks 21, 22 becomes empty or near empty to a point of time at which the replenishment or replacement of the each of the tanks 21, 22 is completed. In this sense, the judging portion 106 is configured to judge that there is a possibility that no liquid is ejected from at least one of the heads 2, 3 toward the sheet P for the given length of time, when the liquid reserved in a corresponding one or ones of the tanks 21, 22 is not larger than the above-described threshold amount. The above-described given length of time is a length of time required for executing the second capping by activation of the head elevator mechanism 95, lip-member driving mechanism 75 and movable-member driving mechanism 85 under control by the controller 100. Further, the judging portion 106 is configured, when the detection signal is outputted from the sensor 92, to judge that there is a possibility that no liquid is ejected from any one of the heads 2, 3 toward the sheet P for a given length of time, because the liquid is not ejected toward the sheet P until completion of replenishment of the sheet supply cassette 24 with the sheet P, which is carried out by the user. Further, the judging portion 106 is configured, when the detection signal is outputted from the sensor 93, to judge that there is a possibility that no liquid is ejected from any one of the heads 2, 3 toward the sheet P for a given length of time, because the liquid is not ejected toward the sheet P until completion of setting of the sheet supply cassette 24 in the supplying position, which is carried out by the user. It is noted that the above-described threshold amount, which is to be compared with an actual amount of the liquid reserved in each of the tanks 21, 22, may be, for example, a value smaller than a minimum value that is required by the controller 100 for receiving a printing command from the user. That is, when at least one of the sensors 91 detects that the amount of the liquid reserved in a corresponding one or ones of the tanks 21, 22 is not larger than the threshold amount, the controller 100 does not execute a printing operation in accordance with the printing command.

Further, the judging portion 106 is configured to judge that there is a possibility that no liquid is ejected from any one of the heads 2, 3 toward the sheet P for a given length of time, also when a main power switch 39 (see FIG. 4) is pressed by the user whereby a power-OFF signal is supplied from the main power switch 39 to the controller 100 (i.e., whereby a power reduction signal is received by the controller 100). This is because no liquid is ejected toward the sheet P since the power supply is placed in its OFF state until the power supply is placed in its ON state, and the placement of the power supply from the OFF state to the ON state is made by the user. Further, there is a possibility that the conveyor belt 43 is replaced by a new one or is subjected to a maintenance operation during the OFF state of the power supply. If the first capping is executed while the conveyor belt 43 is being replaced by a new one or is subjected to a maintenance operation, the conveyor belt 43 or the like could be brought into contact with the ejection surfaces 2*a*, 3*a*, thereby causing a risk that the ejection surfaces 2*a*, 3*a* could be damaged. However, such a risk of damage of the ejection surfaces 2*a*, 3*a* can be avoided by executing the second capping, even if the conveyor belt 43 is replaced by a new one or is subjected to a maintenance operation in a period since the power supply is placed in its OFF state until the power supply is placed in its ON state. Further, the controller 100 may be modified to further include a power-saving-state placing portion 120 (see FIG. 4) that is configured to automatically place the printer 1 into a power-saving mode and to output a power reduction signal indicating that the printer 1 has been placed into the power-saving mode, when any operation has not been carried out in the printer 1 for at least a given length of time. The power-saving mode is a mode in which a consumed amount of electric power is much smaller than in a normal mode in which, for example, a printing operation is being carried out, and in which a supplied amount of electric power is reduced. In this modification with the power-saving-state placing portion 120, the judging portion 106 is configured, when the power reduction signal is outputted by the power-saving state placing portion 120, to judge that there is a possibility that no liquid is ejected from any one of the heads 2, 3 toward the sheet P for a given length of time. This is because no liquid is ejected toward the sheet P until the printer 1 is placed back in the normal mode, and the placement of the printer 1 from the power-saving mode to the normal mode is made by the user.

Further, the judging portion 106 is configured to judge that there is a possibility that no liquid is ejected from any one of the heads 2, 3 toward the sheet P for a given length of time, also when the jam detecting portion 108 detects occurrence of jam of the sheet P. This is because no liquid is ejected toward the sheet P until the printer 1 is recovered from the paper jam, and the recovery operation is made by the user. Still further, the judging portion 106 controls a buzzer 38 (see FIG. 4) such that the buzzer 38 caused to produces a buzzing sound when it is judged that there is a possibility that no liquid is ejected from at least one of the heads 2, 3 toward the sheet P, so that the user can be informed that an amount of the liquid reserved in at least one of the tanks 21, 22 is not larger than the threshold amount, no sheet P is present in the sheet supply cassette 24, the sheet supply cassette 24 is not set in the supplying position and/or paper jam is occurring.

The jam detection portion 108 judges that paper jam occurs only when the sheet P is not detected by the three sheet detection sensors 26-28 with a given time interval. Thus, the three sheet detection sensors 26-28 and the jam detecting portion 108 cooperate to constitute a conveyance-error detector configured to detect an error in conveyance of the sheet. The given time interval is a length of time that is obtained by dividing a distance between each adjacent two of the sheet detection sensors 26-28 (as measured along the conveyance path) by a conveyance velocity of the sheet P. Further, when the jam detecting portion 108 detects occurrence of the paper jam, ejection of the liquid from the heads 2, 3, conveyance of the sheet P and activation of the suction platen 46 are stopped by the head controlling portion 103 and the conveyance controlling portion 101.

Each of the sensors 91 is configured to output a detection signal when the detected amount of the liquid (reserved in the corresponding one of the tanks 21, 22) is not larger than a threshold amount, as described above. The initial-introduction detecting portion 109 is configured to detect that the liquid has been initially introduced into each of the heads 2, 3 from a corresponding one of the tanks 21, 22, when a corresponding one of the five sensors 91 fails to output the detection signals for the first time in the ON state of the power supply which has been established by the user who pressed the main power switch 39. That is, the initial-introduction detecting portion 109 is configured to judge that the initial introduction of the ink into each of the heads 2, 3 from a corresponding one of the tanks 21, 22 has been completed, when a corresponding one of the five sensors 91 fails to output the detection signal for the first time after the power supply of the printer 1 (that had been in its initial state) has been placed in the ON state. The initial introduction means introduction of the precoating liquid or ink into each of the heads 2, 3 (which had not been filled with the precoating liquid or ink) from a corresponding one of the tanks 21, 22 by activation of a corresponding one of the pumps 20. Specifically described, the heads 2, 3 of the printer 1 are filled with a storage solution in the factory setting, and the storage solution is discharged from the heads 2, 3 and the precoating liquid and inks are introduced into the heads 2, 3 by the initial introduction.

The capping executing portion 110 is configured to execute one of the first and second cappings which is selected depending on the operating status. The capping executing portion 110 controls the lip-member driving mechanism 75 when the first capping is to be executed, and controls the lip-member driving mechanism 75, movable-member driving mechanism 85 and head elevator mechanism 95 when the second capping is to be executed.

Specifically described, when the judging portion 106 judges that there is a possibility that no liquid is ejected from at least one of the heads 2, 3 toward the sheet P for a given length of time, the capping executing portion 110 executes the second capping for the at least one of the beads 2, 3, thereby making it possible to restrain drying of the liquid staying in the vicinity of the ejection openings of the at least one of the heads 2, 3 although no liquid is ejected from the at least one of the heads 2, 3 toward the sheet P for the given length of time. Thus, it is possible to restrain drying of the liquid in the vicinity of the ejection openings 2*b*, 3*b* for a while until the tank or tanks 21, 22 is filled with the liquid or replaced with another or other tanks, until the sheet supply cassette 24 is replenished with sheets, until the sheet supply cassette 24 is set in the supplying position, until the printer 1 is recovered from the paper jam, or until the power supply is placed from the OFF state to the ON state.

In response to reception of a cap execution command, the capping executing portion 110 is configured to execute the first capping during the first ejection mode, and is configured to execute the second capping during the second ejection mode. Thus, even when the second ejection mode is being established, it is possible to effectively restrain drying of the liquid staying in the vicinity of the ejection openings 2*a*, 3*a*, by executing the second capping. The cap execution command is outputted when the print data is not received by the controller 100 within a given length of time after placement of the power supply from the OFF state to the ON state by pressing of the main power switch 39. Further, the cap execution command is outputted also upon completion of a printing operation carried out based on the print data stored in the print-data storage portion 102.

The capping executing portion 110 is configured to execute the second capping since the printer 1 is shipped from factory until the initial-introduction detecting portion 109 detects that the liquid is initially introduced from the tanks 21, 22 into the heads 2, 3, and to release the second capping upon detection of the initial introduction by the initial-introduction detecting portion 109. It usually takes at least a certain period of time from shipment of the printer 1 from the factory until ejection of the liquid toward the sheet P. If the storage solution within the ejection openings 2*b*, 3*b* dries, there is a risk that the heads 2, 3 could not sufficiently filled with the precoating liquid and inks upon the initial introduction. However, owing to the second capping, until the initial introduction of the liquid into the heads 2, 3, it is possible to restrain drying of the liquid (storage solution) staying in the vicinity of the ejection openings 2*a*, 3*a* and leakage of the liquid (storage solution) through the ejection openings 2*b*, 3*b*. It is noted that the second capping may be executed even where the heads 2, 3 are not filled with the storage solution in the factory setting.

Further, the capping executing portion 110 is configured to execute the first capping in a period since the sheet P has been conveyed from the conveying unit 40 to the reverse conveying unit 60 until the sheet P has been reversely conveyed from the reverse conveying unit 60 to the conveying unit 40, i.e., in a period since the sheet detection sensor 27 detects a trailing end of the sheet P (conveyed from the conveying unit 40 toward the sheet exit portion 4) until the sheet detection sensor 28 detects a leading end of the sheet P (conveyed away from the sheet exit portion 4 toward the conveying unit 40). The capping executing portion 110 releases the first capping upon detection of the leading end of the sheet P by the sheet detection sensor 28. Thus, the first capping is executed also when the sheet P is being reversely conveyed by the reverse conveying unit 60 to the conveying unit 40, so that it is possible to restrain drying of the liquid staying in the vicinity of the ejection, openings 2*a*, 3*a* while restraining reduction of the throughput.

Further, the capping executing portion 110 is configured to release the first or second capping (that has been executed), when the controller 100 receives the print data transmitted from an external device (e.g., PC).

Next, there will be described an initial operation of the printer 1. The initial operation is initiated by placement of the power supply of the printer 1 from the OFF state to the ON state when the user presses the main power switch 39. In this instance, as long as the printer 1 is in the factory setting, the second capping is executed for each of the heads 2, 8, and the second capping is maintained by the capping executing portion 110 even after the power supply has been placed in the ON state. The five sensors 91 output the detection signals each indicating that the amount of the liquid reserved in a corresponding one of the tanks 21, 22 is not larger than a predetermined amount. Then, when the tanks 21, 22 have been filled with the liquid or new tanks 21, 22 have been set in respective positions, the sensors 91 stop outputting the detection signals, and the pumps 20 are activated, under control by the controller 100, whereby the liquid is introduced into the heads 2, 3 from the tanks 21, 22. Thus, the initial introduction of the liquid into the heads 2, 3 is completed, and the completion of the initial introduction is detected by the initial-introduction detecting portion 109. Upon the detection of the completion of the initial introduction by the initial-introduction detecting portion 109, the second capping (that has been maintained so far) is released by the capping executing portion 110. That is, each of the lip members 72, 73 is returned from the second contact position to the non-contact position, each of the plate-like members 82, 83 is returned from the opposed position to the retracted position, and each of the heads 2, 3 is returned from the distant position to the printing position, thereby establishing the ejectable state in which the liquid is ejectable from each of the heads 2, 3 toward the sheet P.

When the controller 100 does not receive the print data within a given length of time (i.e., a length of time required for the initial introduction of the liquid) after the power supply has been placed into the ON state by pressing of the main power switch 39, the capping executing portion 110 is configured to execute the first or second capping irrespective of whether the initial introduction has been detected or not by the initial-introduction detecting portion 109. In this instance, the capping executing portion 110 executes the first capping when the first ejection mode is being established by the mode establishing portion 111, and executes the second capping when the second ejection mode is being established by the mode establishing portion 111. The initial operation of the printer 1 is completed by the execution of the first or second capping by the capping executing portion 110.

Figure 5:
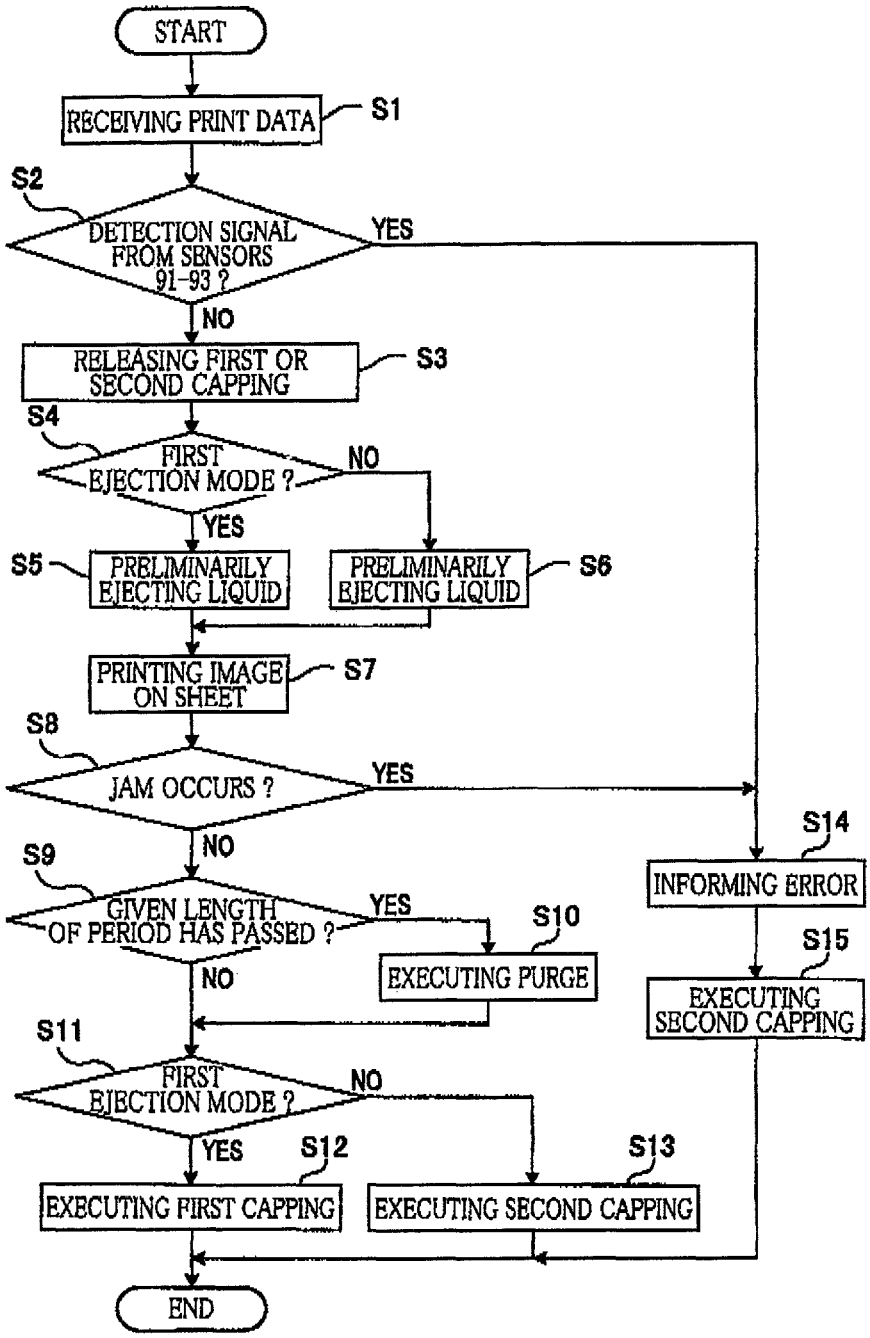
FIG. 5 is a flow chart showing a printing routine that is carried out by the controller of the printer of FIG. 1.

Referring next to FIG. 5, there will be described a printing routine that is carried out in the printer 1. This printing routine is initiated with step S1 in which the printer 1 receives a print data from an external device such as PC. In this step S1, the print-data storage portion 102 stores an image data (contained in the print data) as an ejection data indicative of ejections of the precoating liquid and the inks from the heads 2, 3, and stores also a conveyance data indicative of both-side printing or one-side printing that is to be performed.

Then, in step S2, it is judged whether or not the detection signal has been outputted from at least one of the sensors 91-93. When the detection signal is not outputted from any one of the sensors 91-93, step S2 is followed by step S3. When the detection signal is outputted from at least one of the sensors 91-93, step S2 is followed by step S14.

In step S3, in response to reception of the print data by the controller 100, the capping executing portion 110 releases the first or second capping that has been executed for the heads 2, 3. Then, in step S4, it is judged whether the first ejection mode is being established or not. When the first ejection mode is being established, step S4 is followed by step S5. When the second ejection mode is being established, step is followed by step S6.

In step S5, the preliminary-ejection controlling portion 104 controls the heads 2, 3 such that the liquid is preliminarily ejected from each of the heads 2, 3 by an ejection amount determined for the first ejection mode, toward the surface 44 of the conveyor belt 43. In step S6, the preliminary-ejection controlling portion 104 controls the heads 2, 3 such that the liquid is preliminarily ejected from each of the heads 2, 3 by an ejection amount which is determined for the second ejection mode and which is larger than the above-described ejection amount determined for the first ejection mode, toward the surface 44 of the conveyor belt 48. It is noted that the liquid preliminarily ejected onto the surface 44 is wiped from the surface 44, by activation of the wiper blade 49.

Then, in step S7, in ease of the one-side printing (that is indicated by the conveyance data), the conveyance controlling portion 101 controls the sheet supply tray 23, conveying rollers 32, conveying rollers 34, 85 (that constitute also a part of the reverse conveying unit 60) and conveying unit 40, such that the sheet P is conveyed along the sheet conveying path to the sheet exit portion 4. On the other hand, in case of the both-side printing (that is indicated by the conveyance data), the conveyance controlling portion 101 controls the sheet supply tray 23, conveying rollers 32, reverse conveying unit 60 and conveying unit 40, such that the sheet P is conveyed from the conveying unit 40 to the reverse conveying unit 60, and is then conveyed from the reverse conveying unit 60 to the conveying unit 40, so as to be eventually conveyed to the sheet exit portion 4. In this step S7, while the sheet P is being conveyed as described above, the head controlling portion 103 causes the heads 2, 3 to be activated in accordance with the ejection data stored in the print-data storage portion 102, whereby the liquid is ejected from the ejection openings 2*b*, 3*b* at desired timings. Thus, a color image is recorded in a desired portion on each of both-side faces of the sheet P conveyed by the conveying unit 40, whereby a printing operation for the sheet P is completed.

In this step S7, in case of the both-side printing, the first capping is executed in a period since the sheet detection sensor 27 detects a trailing end of the sheet P until the sheet detection sensor 28 detects a leading end of the sheet P. That is, each of the lip members 72, 73 is moved to the first contact position while the conveyor belt 43 is being caused to run. In this instance, the conveying unit 40 may be controlled by the conveyance controlling portion 101 such that the running velocity of the conveyor belt 43 is reduced to a certain degree (that does not stop the running of the conveyor belt 43). Then, when the sheet detection sensor 28 detects the leading end of the sheet P, the capping executing portion 110 releases the first capping. Thus, the color image is recorded also on a bottom face of the sheet P reconveyed by the conveying unit 40, whereby the printing operation for the sheet P is completed.

Then, in step S8, the jam detecting portion 108 judges whether paper jam is occurring or not. When the jam is not occurring, step S8 is followed by step S9. When the jam is occurring, step S8 is followed by step S14.

In step S9, it is judged whether or not a given length of period has passed since a previous execution of the periodic purge. When the given length of period has passed, step S9 is followed by step S10. When the given length of period has not passed, step S9 is followed by step S11. In step S10, the purge executing portion 105 controls the pumps 20 such that the liquid is ejected from each of the heads 2, 3 toward the surface 44 of the conveyor belt 43. In this instance, the liquid is ejected from each of the heads 2, 3 by an ejection amount determined for the first ejection mode when the first ejection mode is being established, and the liquid is ejected from each of the heads 2, 3 by an ejection amount that is smaller than the ejection amount determined for the first ejection mode when the second ejection mode is being established. It is noted that the liquid ejected onto the surface 44 is wiped from the surface 44, by activation of the wiper blade 49.

Then, in step S11, it is judged whether the first ejection mode is being established or not. When the first ejection mode is being established, step S11 is followed by step S12. When the second ejection mode is being established, step S11 is followed by step S13. In step S12, the capping executing portion 110 executes the first capping in response to the cap execution command that is outputted when the printing operation has been completed. In step S13, the capping executing portion 110 executes the second capping in response to the cap execution command that is outputted when the printing operation has been completed. It is noted that the head controlling portion 103 outputs the cap execution command to the capping executing portion 110 when all the printing operation based on the print data has been completed.

In step S14 that is implemented when a positive judgment (YES) is obtained in step S2 or step S8, the judging portion 106 controls the buzzer 33 such that the user is informed that the amount of the liquid reserved in at least one of the tanks 21, 22 is smaller than a given amount, no sheet P is present in the sheet supply cassette 24, the sheet supply cassette 24 is not set in the supplying position or paper jam is occurring. Step S14 is followed by step S15 in which the capping executing portion 110 executes the second capping. Thus, the printing routine is completed with the first or second capping being executed for each of the heads 2, 3.

In the printer 1 constructed according to the present embodiment as described above, (i) when it is judged by the judging portion 106 that there is a possibility that no liquid is ejected from the heads 2, 3 toward the sheet P for a given length of time, (ii) when the cap execution command is received, (iii) when the initial introduction has not yet been detected by the initial-introduction detecting portion 109, and (iv) when the trailing end of the sheet P has been detected by the sheet detection sensor 27 but the leading end of the sheet P has not yet been detected by the sheet detection sensor 28, it is possible to execute one of the first and second cappings which is selected depending on the operating status such as the ejection mode established by the user, namely, possible to execute a suitable capping. Therefore, when the first capping is executed, it is possible to reduce a length of time required for switching from the capping state to the ejectable state in which the liquid is ejectable from the heads 2, 3. When the second capping is executed, it is possible to increase the performance for preserving the liquid and accordingly to further restrain drying of the liquid staying in the vicinity of the ejection openings 2*b*, 3*b*. In the present embodiment in which one of the first and second cappings (which is selected depending on the operating status) is executed, the second capping can be selected when the operating status is a status requiring a higher priority to be given to maintenance of the performance of the liquid preservation in the heads 2, 3 (which performance can be provided by execution of the second capping) while allowing reduction of the throughput (which reduction could be induced by execution of the second capping), and the first capping can be selected when the operating status is a status requiring a higher priority to be given to improvement of the throughput (which improvement can be provided by execution of the first capping) while sacrificing the performance of the liquid preservation in the heads 2, 3 (which performance could be provided by execution of the second capping).

In the present embodiment, the second capping is executed for at least one of the heads 2, 3 when it is judged by the judging portion 106 that there is a possibility that no liquid is ejected from the at least one of the heads 2, 3 toward the sheet P for a given length of time as described above. This given length of time may be set to be smaller than a length of time required for switching the second capping state to the liquid ejectable state upon reception of the print data by the controller 100, namely, smaller than a sum of a length of time required for releasing the second capping and a length of time required for the maintenance such as the preliminary ejection, in a case when the second capping state has been established for giving a higher priority to improvement of the performance of the liquid preservation in the heads 2, 3 while allowing reduction of the throughput. Further, this given length of time may be set to be larger than a length of time required for switching the first capping state to the liquid ejectable state in a case when the first capping state has been established for giving a higher priority to improvement of the throughput while sacrificing the performance of the liquid preservation in the heads 2, 3. Further, in general, where the controller 100 executes the second capping for giving a higher priority to improvement of the performance of the liquid preservation in the heads 2, 3 while allowing reduction of the throughput, it is preferable that the above-described given length of time is set to a small length of time. Where the controller 100 executes the first capping for giving a higher priority to improvement of the throughput while sacrificing the performance of the liquid preservation in the heads 2, 3, it is preferable that the above-described given length of time is set to a large length of time.

In the present embodiment, the second capping is executed by causing the annular-shaped lip members 72, 73 to be brought into contact with the plate-like members 82, 83. That is, the first and second capping mechanisms 70, 80 are partially constituted by the lip members 72, 73 that are common to the first and second capping mechanisms 70, 80. Thus, the second capping mechanism 80 has a construction that is simplified by employing the lip members 72, 73 as members common to the first and second capping mechanisms 70, 80.

The plate-like members 82, 83 may be modified as needed. For example, an annular-shaped protrusion may be provided on a peripheral portion of an upper surface of each of the plate-like members 82, 83, which is to be opposed to a corresponding one of the ejection surfaces 2*a*, 3*a* when being positioned in the opposed position, such that the annular-shaped protrusion can be brought into contact with a peripheral portion of the corresponding one of the ejection surfaces 2*a*, 3*a*. In this modification with the annular-shaped protrusion, the second cap can be executed by lowering the heads 2, 3 toward the plate-like members 82, 83 positioned in the opposed positions and bringing the ejection surfaces 2*a*, 3*a* into contact with distal end portions of the annular-shaped protrusions. That is, the second capping state can be established by covering the ejection surfaces 2*a*, 3*a* with the plate-like members 82, 83 and the annular-shaped protrusions without employing the annular-shaped lip members 72, 73.

In the present embodiment, the movement mechanism is constituted by the head elevator mechanism 95 that is configured to vertically move the five heads 2, 3. However, this movement mechanism may be modified as needed. For example, the head elevator mechanism 95 may be replaced by a conveying-unit elevator mechanism that is configured to vertically move the conveying unit 40 toward and away from the heads 2, 3. In this modification, the conveying unit 40 is movable relative to the heads 2, 3 by the conveying-unit elevator mechanism, for selectively establishing the recordable state (in which an image can be recorded onto the sheet P by causing the each of the heads 2, 3 to eject the precoating liquid or inks toward the sheet P) and the distant state (in which each of the ejection surfaces 2*a*, 3*a* is distant from the surface 44 by at least a given distance). Further, as another modification, the conveying-unit elevator mechanism may be provided in addition to the head elevator mechanism 95. In this modification, the conveying-unit elevator mechanism and the head elevator mechanism 95 cooperate with each other to move the heads 2, 3 and the conveying unit 40 so as to selectively establish the recordable state and the distant state.

Further, the lip-member driving mechanism 75 is not essential. In a modification without the lip-member driving mechanism 75, the annular-shaped lip members 72, 73 are provided to be fixed relative to the respective heads 2, 3 such that a lower end of each of the lip members 72, 73 (i.e., one of opposite ends of each of the lip members 72, 73 which is close to the conveyor belt 43) is positioned in a position which is distant from the surface 44 and which is located between the ejection surface of a corresponding one of the heads 2, 3 and the surface 44 when the corresponding one of the heads 2, 3 is being positioned in the printing position. In this modification, the first capping can be executed by causing the lip members 2, 3 together with the heads 2, 3 to be moved toward the conveyor belt 43 and bringing the lower ends of the respective lip members 72, 73 into contact with the surface 44. It is noted that, where the above-described conveying-unit elevator mechanism is provided in this modification, the first capping may be executed also by controlling the conveying-unit elevator mechanism such that the conveying unit 40 is moved toward the heads 2, 3 so as to cause the surface 44 to be brought into contact with the lower ends of the respective lip members 72, 73. Further, in this modification, the second capping can be executed by causing the lip members 2, 3 together with the heads 2, 3 to be moved toward the respective plate-like members 82, 83 positioned in the opposed positions and bringing the lower ends of the respective lip members 72, 73 into contact with the respective plate-like members 82, 83.

Further, each of the above-described five sensors 91 may be configured to output the detection signal to the controller 100 when an amount of liquid reserved in a corresponding one of the tanks 21, 22 is smaller than a given amount that corresponds to a half of a maximum amount of liquid that can be reserved in the corresponding one of the tanks 21, 22. Further, the mode establishing portion 111 may be configured to establish the second ejection mode, when the detection signal is outputted from at least one of the sensors 91. In this case, when the amount of the liquid reserved in a corresponding one or ones of the tanks 21, 22 becomes small, an amount of the liquid consumed for the maintenance can be reduced by establishment of the second ejection mode.

Figure 6:
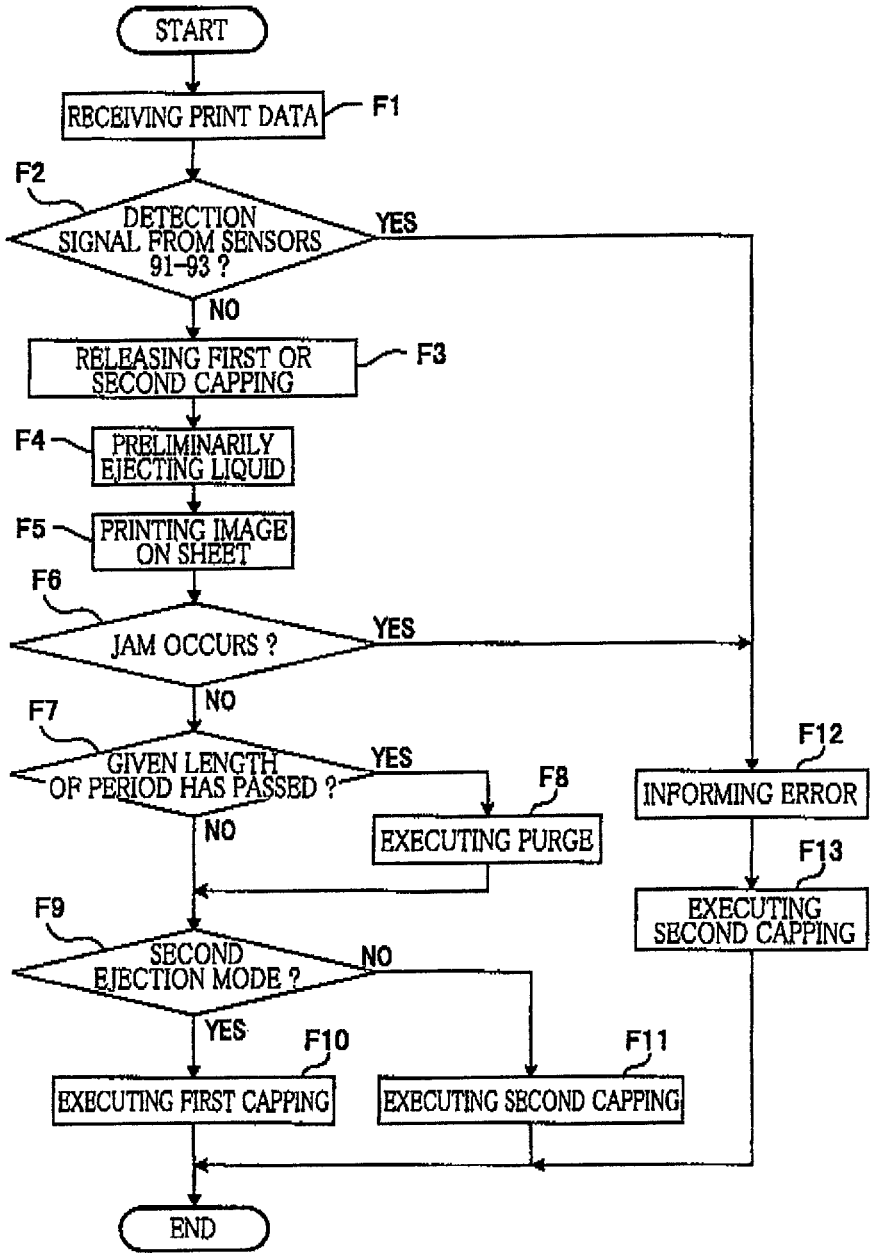
FIG. 6 is a flow chart showing a printing routine that is carried out by a controller of a printer constructed according to a second embodiment of the invention.

Referring next to FIG. 6, the printer 1 constructed according to a second embodiment of the invention will be described. This second embodiment is substantially identical with the above-described first embodiment, except for the mode establishing portion 111 of the controller 100 and a part of the capping executing portion 110 of the controller 100, which are different from those in the first embodiment with respect to content of controls performed therein.

In the present second embodiment, the mode establishing portion 111 is configured to establish one of first and second recording modes which is selectively stored therein in accordance with a setting operation made by an user. A length of time, which is required for starting ejection of the liquid toward the sheet P from reception of a print data (recording command) by the controller 100, is smaller when the second recording mode is being established, than when the first recording mode is being established. An amount of the liquid (i.e., precoating liquid and inks), which is ejected for maintaining the ejection openings 2*b*, 3*b*, is larger when the second recording mode is being established, than when the first recording mode is being established. Therefore, the user selects the second recording mode where he or she prefers to improve the throughput rather than to restrain the amount of the consumption of the precoating liquid and inks, and selects the first recording mode where he or she prefers to restrain the amount of the consumption of the precoating liquid and inks rather than to improve the throughput. It is noted that the first recording mode is established by the mode establishing portion 111 when neither the first recording mode nor the second recording mode is being particularly selected by the user.

The preliminary-ejection controlling portion 104 is configured to control the heads 2, 3 such that the liquid is preliminarily ejected after the first or second capping is released and before the liquid is ejected toward the sheet P. In this instance, when the first recording mode is being established by the mode establishing portion 111, the preliminary-ejection controlling portion 104 controls the heads 2, 3 such that the liquid is ejected from each of the heads 2, 8 by an ejection amount determined for the first recording mode. When the second recording mode is being established by the mode establishing portion 111, the preliminary-ejection controlling portion 104 controls the heads 2, 3 such that the liquid is ejected from the heads 2, 3 for a length of time larger than that determined for the first recording mode.

The purge executing portion 105 is configured to cause the liquid to be forcedly discharged (i.e., ejected by purge execution) from each of the heads 2, 3 toward the surface 44 of the conveyor belt 43, by controlling a corresponding one of the pumps 20 which is provided for delivering the liquid to the each of the heads 2, 3, such that the liquid is forcedly discharged, each time a given period or length of time passes, when a printing operation is not being carried out. The given period or length of time, which may be 20-30 days, for example, is a maximum period or length of time for which each of the heads 2, 3 is likely to be sufficiently maintained by only execution of the above-described preliminary ejection. In other words, it is considered that there is a possibility that each of the heads 2, 3 cannot be sufficiently maintained by only execution of the preliminary ejection when the above-described given period or length of time has passed without execution of the purge. When the first recording mode is being established by the mode establishing portion 111, the purge executing portion 105 controls each of the pumps 20 such that the liquid is discharged from a corresponding one of the heads 2, 3 by an ejection amount determined for the first recording mode. When the second recording mode is being established by the mode establishing portion 111, the purge executing portion 105 controls each of the pumps 20 such that the liquid is discharged from a corresponding one of the heads 2, 3 by an ejection amount which is determined for the second recording mode and which is larger than the above-described ejection amount determined for the first recording mode.

In response to reception of the cap execution command as described above, the capping executing portion 110 is configured to execute the second capping during the first recording mode, and is configured to execute the first capping during the second recording mode. Thus, it is possible to execute one of the first and second cappings which is selected depending on the recording mode established by the user. That is, it takes a smaller length of time for switching from the capping state to the ejectable state (in which the liquid is ejectable from the heads 2, 3 toward the sheet P) when the second recording mode is being established, than when the first recording mode is being established. Therefore, the length of time, which is required for starting ejection of the liquid toward the sheet P from reception of a print data by the controller 100, is smaller when the second recording mode is being established, than when the first recording mode is being established. It is noted that the running velocity of the conveyor belt 43 may be higher during the second recording mode, than during the first recording mode, so that the length of time required for starting ejection of the liquid toward the sheet P from reception of the print data by the controller 100 can be much smaller during the second recording mode than during the first recording mode. It is noted that the capping executing portion 110 is substantially identical with that in the first embodiment, except for the part of the capping executing portion 110 which is related to the mode establishing portion 111.

The initial operation for the printer 1 is initiated of placement of the power supply from the OFF state to the ON state when the user presses the main power switch 39. The initial operation, which is executed as long as the printer 1 is in the factory setting, is carried out substantially in the same manner as in the above-described first embodiment, and redundant description thereof will not be provided herein.

Referring next to FIG. 6, there will be described a printing routine that is carried out in the printer 1. Like in the first embodiment, the printing routine is initiated with step F1 in which the printer 1 receives a print data from an external device such as PC.

Then, in step F2, it is judged whether or not the detection signal has been outputted from at least one of the sensors 91-93. When the detection signal is not outputted from any one of the sensors 91-93, step F2 is followed by step F3. When the detection signal is outputted from at least one of the sensors 91-93, step F2 is followed by step F12.

In step F3, the capping executing portion 110 releases the first or second capping that has been executed for the heads 2, 3. Then, in step F4, the preliminary-ejection controlling portion 104 controls the heads 2, 3 such that the liquid is preliminarily ejected from each of the heads 2, 3 by an ejection amount, toward the surface 44 of the conveyor belt 43. It is noted that the liquid preliminarily ejected onto the surface 44 is wiped from the surface 44, by activation of the wiper blade 49.

Then, steps F5, F6, F7, which are substantially the same as steps S7, S8, S9 in the above-described first embodiment, are implemented. It is noted that steps F12, F13 are substantially the same as steps S14, S15 in the above-described first embodiment.

In step F8, the purge executing portion 105 controls the pumps 20 such that the liquid is ejected from each of the heads 2, 3 toward the surface 44 of the conveyor belt 43. In this instance, the liquid is ejected from each of the heads 2, 3 by an ejection amount determined for the first recording mode. It is noted that the liquid ejected onto the surface 44 is wiped from the surface 44, by activation of the wiper blade 49.

Then, in step F9, it is judged whether the second recording mode is being established or not. When the second recording mode is being established, step F9 is followed by step F10. When the first recording mode is being established, step F9 is followed by step F11. In step F10, the capping executing portion 110 executes the first capping in response to the cap execution command that is outputted when the printing operation has been completed. In step F11, the capping executing portion 110 executes the second capping in response to the cap execution command that is outputted when the printing operation has been completed. Thus, the printing routine is completed with the first or second capping being executed for each of the heads 2, 3.

In the present second embodiment, when a printing operation has been completed, the capping executing portion 110 is configured to execute one of the first and second cappings which is selected depending on the recording mode established by the mode establishing portion 111. However, the capping executing portion 110 may be modified to execute the first capping upon completion of a printing operation performed based on a print data received by the controller 100, and to release the first capping and execute the second capping when the controller 100 has not yet received a print data for a next printing operation even after a given length of time has passed from the completion of the printing operation. In this modification, when a next printing operation is carried out within the given length of time, the first capping is executed whereby a length of time required for starting the next printing operation can be reduced. When a next printing operation is not carried out within the given length of time, the second capping is executed whereby drying of the liquid staying in the vicinity of the ejection openings 2*b*, 3*b* can be effectively restrained. It is noted that the given length of time may be any desired length of time such as 30-60 minutes.

Figure 7:
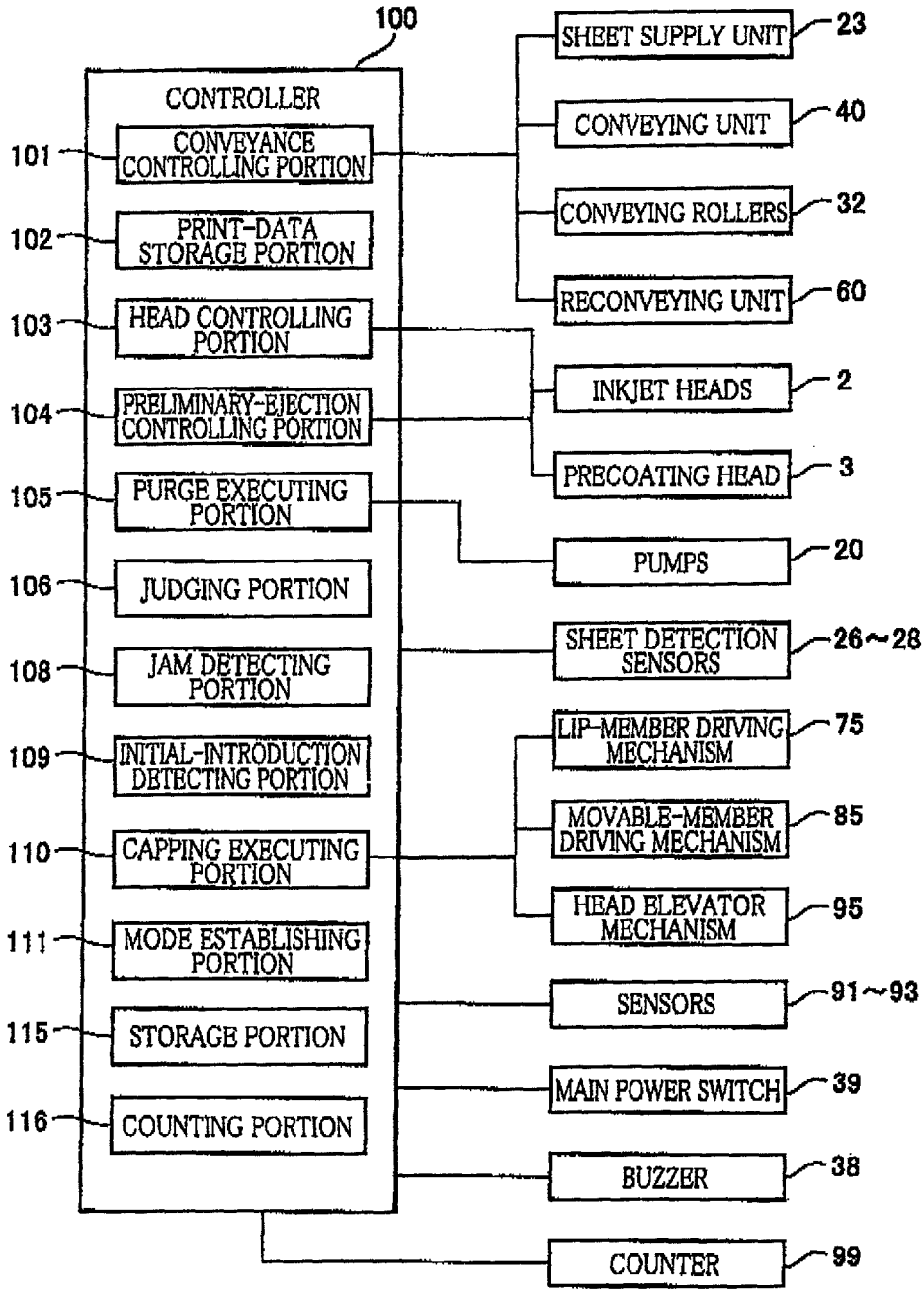
FIG. 7 is a block diagram showing construction of a controller included in an inkjet printer constructed according to a third embodiment of the invention.

Referring next to FIG. 7, there will be described a printer constructed according to a third embodiment of the invention. The printer according to the present third embodiment is substantially the same as the printer according to the above-described first embodiment except for components constituting a part of the controller 100.

In the present third embodiment, as shown in FIG. 7, the controller 100 includes a storage portion 115 and a counting portion 116 in addition to the components (i.e., the above-described conveyance controlling portion 101, print-data storage portion 102, head controlling portion 103, preliminary-ejection controlling portion 104, purge executing portion 105, judging portion 106, jam detecting portion 108, initial-introduction detecting portion 109, capping executing portion 110 and mode establishing portion 111) that are included in the controller 100 in the above-described first embodiment. Further, to the controller 100, there is connected a counter 99 as a time measuring portion that is configured to measure a length of time.

The storage portion 115 is configured to store, based on the length of time measured by the counter 99, points of times at which the print data is received by the controller 100. The counting portion 116 is configured to count a number of times the controller has received the print data in each of a plurality of periods into which one day (24 hours) is divided. The plurality of periods may consist of for example, a first period that is after 0 o'clock until 6 o'clock, a second period that is after 6 o'clock until 12 o'clock, a third period that is after 12 o'clock until 18 o'clock, and a fourth period that is after 18 o'clock until 24 (0) o'clock.

In response to reception of the cap execution command, the capping executing portion 110 is configured to execute the second capping during a period in which the counted number of times of reception of the print data is not larger than a given number of times, and is configured to execute the first capping during a period in which the counted number of times of reception of the print data is larger than the given number of times. The given number of times may be any desired number of times such as 500-1000 times. Owing to this arrangement, the length of time required for starting a printing (recording) operation can be reduced in the period in which the print data is received highly frequently, and the drying of the liquid staying in the vicinity of the ejection openings 2*b*, 3*b* can be effectively restrained in the period in which the print data is not received highly frequently. For example, in a period in which the number of times of reception of the print data is relatively large, if a required level of throughput could not be obtained by executing the second capping each time a printing operation has been completed, the above-described given number of times is set to be smaller than the number of times of reception of the print data in the period, so that the capping executing portion 110 executes the first capping (rather than the second capping) in the period. On the other hand, in another period in which the number of times of reception of the print data is relatively small, if a required level of throughput could be obtained even by executing the second capping each time a printing operation has been completed, the above-described given number of times may be set to be larger than the number of times of reception of the print data in the period.

In the printer according to the present third embodiment, the capping executing portion 110 executes one of the first and second cappings, in response to the cap execution command outputted upon completion of a printing operation. That is, the first capping is executed in the period in which the number of times of reception of the print data is larger than the given number of times, and the second capping is executed in the period in which the number of times of reception of the print data is smaller than the given number of times. Thus, the printing routine is completed with the first or second capping being executed for each of the heads 2, 3.

Figure 8:
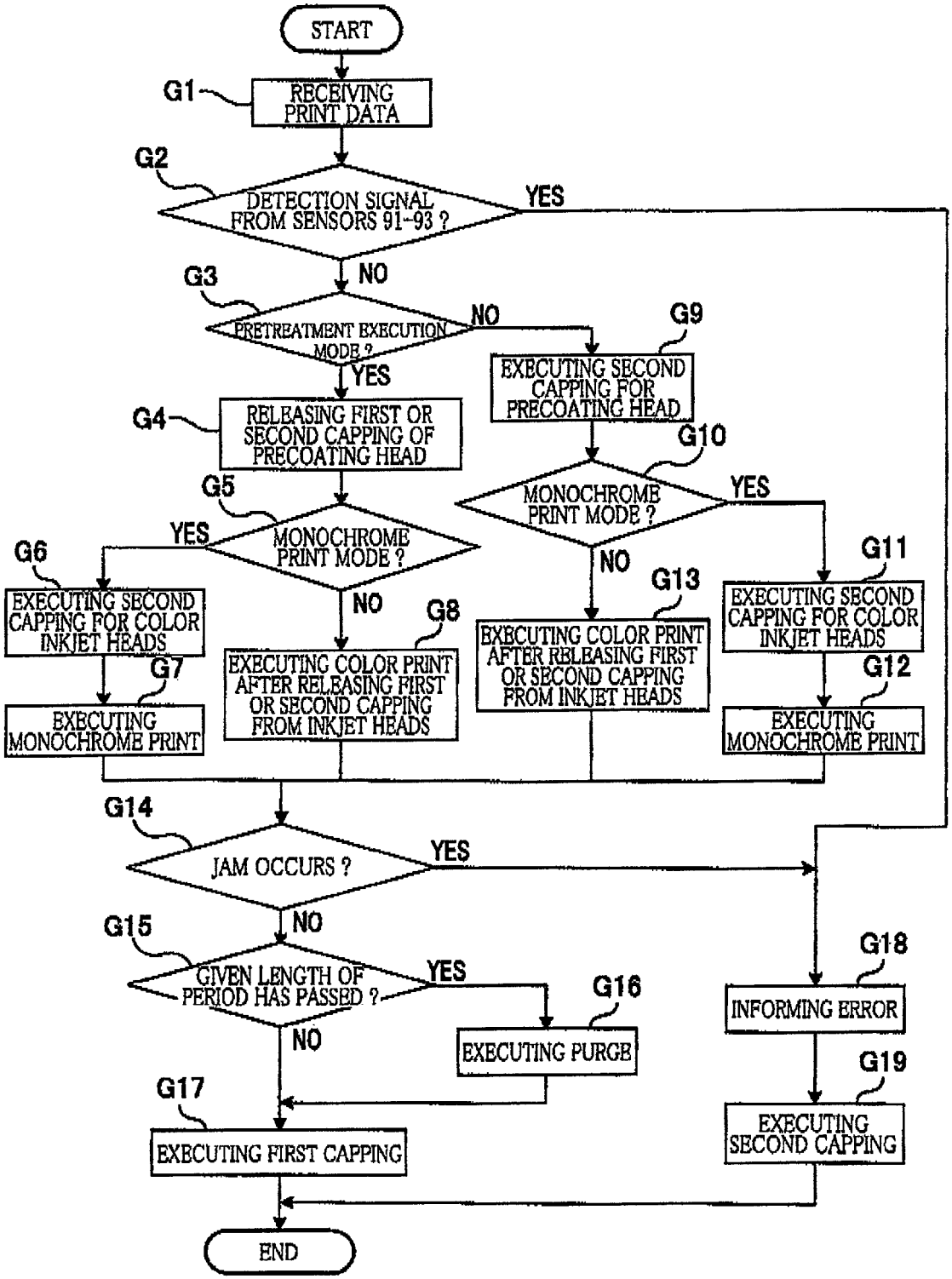
FIG. 8 is a flow chart showing a printing routine that is carried out by a controller of a printer constructed according to a fourth embodiment of the invention.

Referring next to FIG. 8, there will be described a printer constructed according to a fourth embodiment of the invention. This fourth embodiment is substantially identical with the above-described first embodiment, except for the mode establishing portion 111 of the controller 100 and a part of the capping executing portion 110 of the controller 100, which are different from those in the first embodiment with respect to content of controls performed therein.

In the present fourth embodiment, either one of the first and second cappings may exhibit a higher performance for preserving the liquid than the other of the first and second cappings. For example, an entirety or a part of the surface 44 of the conveyor belt 43 may be covered with a water repellent coating that is made of for example, fluorocarbon polymer. Further, the length of time required for establishing the liquid ejectable state from the first capping state may be either smaller or larger than the length of time required for establishing the liquid ejectable state from the second capping state.

In the present fourth embodiment, the mode establishing portion 111 is configured to establish one of a pretreatment execution mode and a pretreatment skip mode (as an example of a partial ejection mode) which is selectively stored therein in accordance with a setting operation made by an user. When the pretreatment execution mode is being established, a printing operation is carried out with a pretreatment in which the precoating liquid is ejected from the head 8 toward the sheet P. When the pretreatment skip mode is being established, a printing operation is carried out without the pretreatment. Further, the mode establishing portion 111 is configured to establish one of a color printing mode and a monochrome printing mode (partial ejection mode) which is selectively stored therein in accordance with a setting operation made by the user. When the color printing mode is being established, a full-color printing operation is carried out by causing the four heads 2 to eject inks. When the monochrome mode is being established, a monochrome printing operation is carried out by causing the black-ink head 2 to eject black ink. It is noted that the pretreatment execution mode and the color printing mode are established when none of these modes is being particularly selected by the user.

The mode establishing portion 111 may be modified as needed. For example, when the detection signal is outputted from at least one of the five sensors 91, the mode establishing portion 111 may be configured to establish the partial ejection mode in which the liquid is not ejected from a corresponding one or ones of the heads 2, 3 corresponding to the above-described at least one of the five sensors 91 while the liquid is ejected from the other of the heads 2, 3. That is, in this modification, the partial ejection mode is a mode in which an image is recorded onto the sheet P by ejection of the liquid from only at least one of the heads 2, 3 to each of which the liquid is supplied from a corresponding one of the tanks 21, 22 that stores the liquid, whose amount is larger than a given amount (so that the detection signal is not outputted from a corresponding one of the sensors 91), without ejection of the liquid from the other of the heads 2, 3. Therefore, even if the amount of the ink reserved in some of the tanks 21, 22 becomes smaller than the given amount, an image can be recorded by using the heads 2, 3 corresponding to the other of the tanks 21, 22. Further, the mode establishing portion 111 may be configured to establish the pretreatment skip mode as the partial ejection mode, when the detection signal is outputted from one of the five sensors 91 that is configured to detect an amount of the precoating liquid reserved in the tank 21 from which the precoating liquid is to be supplied to the precoating head 3. Still further, the mode establishing portion 111 may be configured to establish the monochrome printing mode as the partial ejection mode, when the detection signal is outputted from at least one of the five sensors 91 which is other than one of the five sensors 91 that is configured to detect an amount of the black ink reserved in the tank 22 from which the black ink is to be supplied to the black-ink head 2.

The capping executing portion 110 is configured to execute the second capping for at least one of the heads 2, 3 that is other than one or ones of the heads 2, 3 that are selected (depending on the mode established by the mode establishing portion 111) as activated head or heads activated to eject the liquid. Specifically, the capping executing portion 110 executes the second capping for the precoating head 3, when the pretreatment skip mode is being established. The capping executing portion 110 executes the second capping for each of the heads other than the black-ink head 2, when the monochrome printing mode is being established. The capping executing portion 110 does not execute the second capping for the heads 2, 3, when the pretreatment execution mode and/or the color printing mode are being established. It should be noted that the sheet conveying path defined between the surface 44 and the ejection surfaces 2*a*, 3*a* is blocked or closed when the first capping is being executed, because the first capping state is established for each of the heads 2, 3, by covering a corresponding one of the ejection surfaces 2*a*, 3*a* with a corresponding one of the annular-shaped lip members 72, 73 and the surface 44 of the conveyor belt 43. Therefore, the first capping can not be executed for any one of the heads 2, 3 while a printing operation is being carried out. However, the second capping can be executed for each of the non-activated head or heads other than the activated head or heads, for restraining drying of the liquid staying in the vicinity of the ejection openings of the non-activated head or heads, without blocking or closing the sheet conveying path.

In response to reception of the cap execution command as described above, the capping executing portion 110 is configured to execute the first capping for at least one of the heads 2, 3 that is selected (depending on the mode established by the mode establishing portion 111) as activated head or heads activated to eject the liquid. Specifically, the capping executing portion 110 executes the first capping for each of the heads 2, when the pretreatment skip mode is being established. The capping executing portion 110 executes the first capping for the black-ink head 2, when the monochrome printing mode is being established. Thus, upon reception of the cap execution command, the first capping is executed for at least one of the heads 2, 3 that is to be activated for recording an image on the sheet P, thereby making it possible to restrain drying of the liquid staying in the vicinity of the ejection openings of the activated head or heads. It is noted that the capping executing portion 110 is substantially identical with that in the first embodiment, except for the part of the capping executing portion 110 which is related to the mode establishing portion 111.

When the controller 100 does not receive the print data within a given length of time (i.e., a length of time required for the initial introduction of the liquid) after the power supply has been placed into the ON state by pressing of the main power switch 39, the capping executing portion 110 is configured to execute the first or second capping irrespective of whether the initial introduction has been detected or not by the initial-introduction detecting portion 109. In this instance, the capping executing portion 110 executes one of the first and second cappings that is selected depending on the mode that is being established by the mode establishing portion 111, such that the first or second capping is executed for at least one of the heads 2, 3 which is selected depending on the established mode.

Referring next to FIG. 8, there will be described a printing routine that is carried out in the printer 1. Like in the first embodiment, the printing routine is initiated with step G1 in which the printer 1 receives a print data from an external device such as PC.

Then, in step G2, it is judged whether or not the detection signal has been outputted from at least one of the sensors 91-93. When the detection signal is not outputted from any one of the sensors 91-93, step G2 is followed by step G3. When the detection signal is outputted from at least one of the sensors 91-93, step G2 is followed by step G18.

In step G3, it is judged whether the pretreatment execution mode is being established or not. When the pretreatment execution mode is being established, step G3 is followed by step G4. When the pretreatment skip mode is being established, step G3 is followed by step G9. In step G4, the capping executing portion 110 releases the first or second capping from the promoting head 3. In step G9, the capping executing portion 110 executes the second capping for the precoating head 3. In this step G9, the second capping state is simply maintained for the head 3 if the second capping state has been already established for the head 3 even before implementation of step G9.

Step G4 is followed by step G5 in which it is judged whether the monochrome printing mode is being established or not. When the monochrome printing mode is being established, step G5 is followed by step G6. When the color printing mode is being established, step G5 is followed by step G8. In step G6, the capping executing portion 110 releases the first or second capping from the black-ink head 2, and executes the second capping for each of the three color-ink heads 2. In this step G6, the second capping state is simply maintained for each of the three colorink heads 2 if the second capping state has been already established for each of the three color-ink heads 2 even before implementation of step G6.

Then, in step G7, in case of the one-side printing, the conveyance controlling portion 101 controls the sheet supply tray 23, conveying rollers 32, conveying rollers 34, 35 (that constitute also a part of the reverse conveying unit 60) and conveying unit 40, such that the sheet P is conveyed along the sheet conveying path to the sheet exit portion 4. On the other hand, in case of the both-side printing, the conveyance controlling portion 101 controls the sheet supply tray 23, conveying rollers 32, reverse conveying unit 60 and conveying unit 40, such that the sheet P is conveyed from the conveying unit 40 to the reverse conveying unit 60, and is then conveyed from the reverse conveying unit 60 to the conveying unit 40, so as to be eventually conveyed to the sheet exit portion 4. In this step G7, while the sheet P is being conveyed as described above, the head controlling portion 103 causes the recoating head 2 and black-ink head 3 to be activated in accordance with the ejection data stored in the print-data storage portion 102, whereby the liquid in the form of droplets having desired volumes is ejected from the ejection openings 2*b*, 3*b* at desired timings. Thus, a monochrome image is recorded in a desired portion on each of both-side faces of the sheet P conveyed by the conveying unit 40, whereby a printing operation for the sheet P is completed.

In step G8, after the capping executing portion 110 releases the first or second capping from each of the four heads 2, substantially the same procedures as those in step S7 of the first embodiment are carried out, whereby a color image is recorded in a desired portion on each of both-side faces of the sheet P conveyed by the conveying unit 40, whereby a printing operation for the sheet P is completed.

In step G10, it is judged whether the monochrome printing mode is being established or not. When the monochrome printing mode is being established, step G10 is followed by step G11. When the color printing mode is being established, step G10 is followed by step G13. In step G11, the capping executing portion 110 releases the first or second capping from the black-ink head 2, and executes the second capping for each of the three color-ink heads 2 (that are other than the black-ink head 2). In this step G11, the second capping state is simply maintained for each of the three color-ink heads 2 if the second capping state has been already established for each of the three color-ink heads 2 even before implementation of step G11.

Then, step G12 is implemented by carrying out procedures that are substantially the same as those in step G7 except for no activation of the precoating head 3, so that a monochrome image is recorded in a desired portion on each of both-side faces of the sheet P conveyed by the conveying unit 40, whereby a printing operation for the sheet P is completed.

In step G13, the first or second capping is released from each of the four heads 4, by the capping executing portion 110, and then procedures that are substantially the same as those in step G8 except for no activation of the precoating head 3, are carried out so that a color image is recorded in a desired portion on each of both-side faces of the sheet P conveyed by the conveying unit 40, whereby a printing operation for the sheet P is completed.

Then, steps G14, G15, G16, which are substantially the same as steps F6, F7, F8 in the above-described second embodiment, are implemented. It is noted that steps G18, G19 are substantially the same as steps F12, F18 in the above-described second embodiment.

In step G17, in response to the cap execution command that is outputted when the printing operation has been completed, the capping executing portion 110 executes the first capping for at least one of the heads 2, 3 that is selected (depending on the mode established by the mode establishing portion 111) as activated head or heads that are to activated to eject the liquid. The at least one of the heads 2, 3 as the activated head or heads is selected depending on which one of the pretreatment execution mode and pretreatment skip mode is being established and depending on which one of the monochrome printing mode and color printing mode is being established. In this instance, the second capping is maintained for non-activated head or heads that are not to be activated to eject the liquid.

While the presently preferred embodiments of the invention have been described above in detail, it is to be understood that the invention is not limited to the details of the illustrated embodiments, but may be otherwise embodied without departing from the scope and spirit of the invention defined in the appended claims. For example, in the above-described embodiments, the mode establishing portion 111 is configured to establish a mode or modes, by storing therein the mode or modes which are selected in accordance with a setting operation carried out by the user. However, the mode establishing portion 111 may be modified to automatically establish a mode or modes, when receiving a print data containing data indicative of the mode or modes that are to be established.

Further, while the conveying unit 40 including the conveyor belt 43 is employed as the conveying mechanism for conveying the sheet P in the above-described embodiments, it is possible to employ another conveying mechanism such as a known platen conveying mechanism including rollers and a platen. In this case, the above-described support surface is constituted by an upper surface of the platen.

Further, while the switching means is constituted mainly by the controller 100 in the above-described embodiments, the switching means may be otherwise constituted. For example, the first and second capping mechanisms may be constituted by capping mechanisms that are removably attached to the housing body 1*a* of the printer 1, so that each one of the first and second capping mechanisms can be switched to the other, by manually removing the one from the housing body 1*a* and attaching the other to the housing body 1*a*, by the user. Further, each one of the first and second capping mechanisms can be switched to the other, by only a mechanical arrangement.

Further, the present invention is applicable to both of a line type printer and a serial type printer. Still further, the present invention is applicable not only to a printer but also to other apparatus such as a facsimile machine and a copy machine. Moreover, the invention is applicable also to a recording apparatus in which a recording operation is carried out by ejecting a liquid other than an ink. The recording medium does not necessarily have to be a sheet P but may be any other kind of medium that is usable for recording images or characters.

What is claimed is:

1. A recording apparatus comprising:

at least one liquid ejection head each of which has an ejection surface defining ejection openings, and each of which is configured to eject liquid through said ejection openings;

a conveying mechanism having a support surface, and configured to convey a recording medium, such that the recording medium supported on said support surface passes a position that is opposed to said ejection surface;

a first capping mechanism comprising having at least one annular-shaped lip member each of which is disposed around a corresponding one of said at least one liquid ejection head so as to surround said ejection surface of said corresponding one of said at least one liquid ejection head, said first capping mechanism being configured to execute a first capping that causes said ejection surface of each of said at least one liquid ejection head to be covered with said support surface and a corresponding one of said at least one annular-shaped lip member, by bringing a lower end of said corresponding one of said at least one annular-shaped lip member into contact with said support surface;

a second capping mechanism comprising at least one movable member each of which is positionable in an opposed position and a retracted position, such that each of said at least one movable member is opposed to said ejection surface of a corresponding one of said at least one liquid ejection head while being positioned in the opposed position, and such that each of said at least one movable member is not opposed to said ejection surface of a corresponding one of said at least one liquid ejection head while being positioned in the retracted position, said second capping mechanism being configured to execute a second capping that causes said ejection surface of each of said at least one liquid ejection head to be covered with at least a corresponding one of said at least one movable member, by positioning said corresponding one of said at least one movable member in the opposed position; and a controller configured to control said first capping mechanism and said second capping mechanism, and to execute a selected one of the first capping and the second capping.

2. The recording apparatus according to claim 1, further comprising a movement mechanism configured to move said at least one liquid ejection head and/or said conveying mechanism, for enabling each of said at least one liquid ejection head and said conveying mechanism to cooperate to establish a recordable state and a distant state, such that the recordable state is established, when an image is to be recorded onto the recording medium that is conveyed by said conveying mechanism, by causing said each of said at least one liquid ejection head to eject the liquid toward the recording medium, and such that said each of said at least one liquid ejection head and said support surface are distant from each other by a larger distance when the distant state is being established than when the recordable state is being established, wherein said controller is configured, when the first capping is to be executed, to control said movement mechanism such that the recordable state is established by cooperation of said each of said at least one liquid ejection head and said conveying mechanism, and wherein said controller is configured, when the second capping is to be executed, to control said movement mechanism such that the distant state is established by cooperation of said each of said at least one liquid ejection head and said conveying mechanism.

3. The recording apparatus according to claim 2, further comprising a lip-member driving mechanism configured to move each of said at least one annular-shaped lip member relative to a corresponding one of said at least one liquid ejection head, wherein said second capping mechanism includes a movable-member driving mechanism configured to move each of said at least one movable member between the opposed position and the retracted position, wherein said controller is configured to control said lip-member driving mechanism when the first capping is released to establish a liquid ejectable state in which the liquid is ejectable from said at least one liquid ejection head toward the recording medium, wherein said controller is configured to control said lip-member driving mechanism, said movable-member driving mechanism and said movement mechanism when the second capping is released to establish the liquid ejectable state, and wherein a length of time from release of the first capping to establishment of the liquid ejectable state is smaller than a length of time from release of the second capping to establishment of the liquid ejectable state.

4. The recording apparatus according to claim 1, wherein said ejection surface of each of said at least one liquid ejection head cooperates with said support surface and said corresponding one of said at least one annular-shaped lip member to define an enclosed space upon execution of the first capping, wherein said ejection surface of each of said at least one liquid ejection head cooperates with at least said corresponding one of said at least one movable member to define an enclosed space upon execution of the second capping, and wherein a degree of tightness of the enclosed space defined upon execution of the second capping is higher than a degree of tightness of the enclosed space defined upon execution of the first capping.

5. The recording apparatus according to claim 1, further comprising:

at least one liquid reservoir each of which is configured to supply the liquid to a corresponding one of said at least one liquid ejection head; and at least one liquid detector each of which is configured to detect that an amount of the liquid reserved in a corresponding one of said at least one liquid reservoir is not larger than a predetermined amount, wherein said controller is configured, when each of said at least one liquid detector detects that the amount of the liquid reserved in a corresponding one of said at least one liquid reservoir is not larger than the predetermined amount, to execute the second capping.

6. The recording apparatus according to claim 1, further comprising:

a recording-medium storage configured to store therein the recording medium; and a recording-medium detector configured to detect whether the recording medium is present or absent in said recording-medium storage, wherein said controller is configured to execute the second capping, when said recording-medium detector detects that the recording medium is absent in said recording-medium storage.

7. The recording apparatus according to claim 1, further comprising:

a recording-medium storage which is configured to store therein the recording medium, and which is removably attached to a main body of said recording apparatus; and a storage disposition detector configured to detect whether said recording-medium storage is disposed in a supplying position that enables the recording medium to be supplied from said recording-medium storage to said conveying mechanism, wherein said controller is configured to execute the second capping, when said storage disposition detector detects that said recording-medium storage is not disposed in the supplying position.

8. The recording apparatus according to claim 1, further comprising a conveyance-error detector configured to detect an error in conveyance of the recording medium by said conveying mechanism, wherein said controller is configured to execute the second capping, when said conveyance-error detector detects the error in the conveyance of the recording medium.

9. The recording apparatus according to claim 1, wherein said controller includes a power-saving-state placing portion configured to place said recording apparatus into a power-saving state in which an amount of electric current supplied to said recording apparatus is smaller than in a state in which the image is recorded on the recording medium, and wherein said controller is configured to execute the second capping, when said recording apparatus is placed in the power-saving state by said power-saving-state placing portion.

10. The recording apparatus according to claim 1, wherein said controller further includes an ejection-mode establishing portion configured to establish selectively a first ejection mode and a second ejection mode, such that the liquid is ejected through said ejection openings for maintenance of said ejection openings when either of the first and second ejection modes is being established, and such that an amount of the liquid ejected through said ejection openings is smaller when the second ejection mode is being established, than when the first ejection mode is being established, and wherein said controller is configured to execute the first capping when the first ejection mode is being established, and to execute the second capping when the second ejection mode is being established.

11. The recording apparatus according to claim 10, wherein said controller includes a preliminary-ejection controlling portion configured to control said at least one liquid ejection head such that the liquid is preliminarily ejected through said ejection openings, and wherein said preliminary-ejection controlling portion is configured to cause the liquid to be preliminarily ejected through said ejection openings by an amount smaller when the second ejection mode is being established, than when the first ejection mode is being established.

12. The recording apparatus according to claim 10, wherein said controller includes a purge executing portion configured to cause the liquid to be forcedly ejected from said at least one liquid ejection head, and wherein said purge executing portion is configured to cause the liquid to be forcedly ejected through said ejection openings by an amount smaller when the second ejection mode is being established, than when the first ejection mode is being established.

13. The recording apparatus according to claim 1, wherein said controller further includes a recording-mode establishing portion configured to establish selectively a first recording mode and a second recording mode, such that the liquid is ejected toward the recording medium in response to reception of a recording data by said controller when either of the first and second recording modes is being established, and such that a length of time from the reception of the recording data to ejection of the liquid is shorter when the second recording mode is being established, than when the first ejection mode is being established, and wherein said controller is configured to execute the second capping when the first recording mode is being established, and to execute the first capping when the second recording mode is being established.

14. The recording apparatus according to claim 1, wherein said controller is configured to execute the first capping, when ejection of the liquid required for an image recording operation performed onto the recording medium is completed, and wherein said controller is configured to release the first capping and to execute the second capping, when a predetermined length of time has passed from completion of the ejection of the liquid, without a next image recording operation being performed.

15. The recording apparatus according to claim 1, wherein said at least one liquid ejection head consists of a plurality of liquid ejection heads, wherein said controller further includes a partial-ejection-mode establishing portion configured to establish a partial ejection mode, such that an image is recorded onto the recording medium by only a part of said plurality of liquid ejection heads when the partial ejection mode is being established, and wherein said controller is configured to execute the second capping for at least one of said plurality of liquid ejection heads which is other than said part of said plurality of liquid ejection heads, when the partial ejection mode is being established.

16. The recording apparatus according to claim 15, wherein said controller is configured to execute the first capping for said part of said plurality of liquid ejection heads, when the partial ejection mode is being established.

17. The recording apparatus according to claim 15, further comprising:

a plurality of liquid reservoirs each of which is configured to supply the liquid to a corresponding one of said plurality of liquid ejection heads; and a liquid detector configured to detect that an amount of the liquid reserved in each of said plurality of liquid reservoirs is larger than a predetermined amount, wherein said partial-ejection-mode establishing portion is configured to establish the partial ejection mode, such that the image is recorded onto the recording medium by only at least one of said plurality of liquid ejection heads to each of which the liquid is supplied from a corresponding one of said plurality of liquid reservoirs that stores the liquid, whose amount is larger than the predetermined amount according to detection made by said liquid detector.

18. The recording apparatus according to claim 15, wherein said controller includes a preliminary-ejection controlling portion configured to control said at least one liquid ejection head, such that the liquid is preliminarily ejected through said ejection openings after the first capping has been released by said controller, and such that the liquid is preliminarily ejected through said ejection openings after the second capping has been released by said controller, and wherein said preliminary-ejection controlling portion is configured to cause the liquid to be preliminarily ejected through said ejection openings by an amount smaller after the second capping has been released by said controller, than after the first capping has been released by said controller.

19. The recording apparatus according to claim 1, wherein said at least one annular-shaped lip member constitutes a part of said second capping mechanism as well as a part of said first capping mechanism, and wherein said second capping mechanism is configured to execute the second capping that causes said ejection surface of each of said at least one liquid ejection head to be covered with a corresponding one of said at least one annular-shaped lip member and a corresponding one of said at least one movable member that is positioned in the opposed position.

* * * * *